US008537062B1

(12) United States Patent
Duzdar et al.

(10) Patent No.: US 8,537,062 B1
(45) **Date of Patent: *Sep. 17, 2013**

(54) LOW-PROFILE ANTENNA ASSEMBLIES

(71) Applicant: Laird Technologies, Inc., Earth City, MO (US)

(72) Inventors: Ayman Duzdar, Grand Blanc, MI (US); Gary Keith Reed, Grand Blanc, MI (US); Thomas Shirley, Chesaning, MI (US); David Allen Swartwood, Swartz Creek, MI (US)

(73) Assignee: Laird Technologies, Inc., Earth City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/853,850

(22) Filed: Mar. 29, 2013

Related U.S. Application Data

(63) Continuation-in-part of application No. 12/895,379, filed on Sep. 30, 2010, and a continuation-in-part of application No. PCT/US2011/054280, filed on Sep. 30, 2011, and a continuation-in-part of application No. PCT/US2012/069985, filed on Dec. 14, 2012.

(60) Provisional application No. 61/570,534, filed on Dec. 14, 2011.

(51) Int. Cl.
*H01Q 1/32* (2006.01)
*H01Q 1/12* (2006.01)
*H01Q 1/42* (2006.01)

(52) U.S. Cl.
USPC ..... 343/713; 343/872; 343/878

(58) Field of Classification Search
None
See application file for complete search history.

(56) References Cited

U.S. PATENT DOCUMENTS

| | | | | |
|---|---|---|---|---|
| 7,034,758 | B2 | 4/2006 | Haidacher et al. | |
| 7,091,912 | B2 * | 8/2006 | Iacovella et al. | 343/713 |
| 7,239,281 | B2 | 7/2007 | Lu | |
| 7,295,167 | B2 | 11/2007 | Aminzadeh et al. | |
| 7,304,614 | B2 | 12/2007 | Silva et al. | |
| 7,333,065 | B2 | 2/2008 | Lindackers et al. | |
| 7,429,958 | B2 | 9/2008 | Lindackers et al. | |
| 7,489,280 | B2 | 2/2009 | Aminzadeh et al. | |
| 7,492,318 | B2 * | 2/2009 | Duzdar et al. | 343/711 |
| 7,492,319 | B2 | 2/2009 | Lindackers et al. | |

(Continued)

FOREIGN PATENT DOCUMENTS

| | | |
|---|---|---|
| CN | 101217213 | 7/2008 |
| CN | 300827936 | 9/2008 |

(Continued)

OTHER PUBLICATIONS

Photos of Antenna Products Ordered Jun. 2010; 6 pages.

(Continued)

*Primary Examiner* — Trinh Dinh
(74) *Attorney, Agent, or Firm* — Harness, Dickey & Pierce, P.L.C.

(57) ABSTRACT

A low-profile antenna assembly includes at least two antennas co-located under a cover. At least one of the at least two antennas includes an antenna configured for use with AM/FM radio. And, at least one of the at least two antennas includes an antenna configured for use with at least one or more of SDARS, GPS, cell phones, Wi-Fi, DAB-VHF-III, DAB-L, etc.

19 Claims, 36 Drawing Sheets

(56) References Cited

U.S. PATENT DOCUMENTS

| | | | | |
|---|---|---|---|---|
| D591,271 | S | 4/2009 | Lindackers et al. | |
| 7,633,452 | B2 | 12/2009 | Noro et al. | |
| 7,755,551 | B2 | 7/2010 | Lindackers et al. | |
| 8,081,126 | B2 | 12/2011 | Ikeda et al. | |
| 8,248,315 | B2 | 8/2012 | Lindackers et al. | |
| 2005/0062658 | A1 | 3/2005 | Magg et al. | |
| 2005/0219131 | A1 | 10/2005 | Haidacher et al. | |
| 2006/0220970 | A1 | 10/2006 | Aminzadeh et al. | |
| 2008/0111752 | A1 | 5/2008 | Lindackers et al. | |
| 2008/0198077 | A1 | 8/2008 | Duzdar et al. | |
| 2010/0013724 | A1 | 1/2010 | Ohshima et al. | |
| 2010/0136936 | A1 | 6/2010 | Jiang | |
| 2010/0277379 | A1* | 11/2010 | Lindackers et al. | 343/713 |
| 2011/0221640 | A1 | 9/2011 | Huber | |
| 2012/0001811 | A1 | 1/2012 | Yoo et al. | |
| 2012/0081253 | A1* | 4/2012 | Duzdar et al. | 343/713 |

FOREIGN PATENT DOCUMENTS

| | | |
|---|---|---|
| KR | 10-0843150 | 7/2008 |
| WO | WO 2009/065806 | 5/2009 |
| WO | WO 2010/036435 | 4/2010 |
| WO | WO 2010/055051 | 5/2010 |
| WO | WO 2010/107258 | 9/2010 |
| WO | WO2011/051454 | 5/2011 |
| WO | WO 2012/044968 | 4/2012 |

OTHER PUBLICATIONS

International Search Report from PCT/US2009/049704 (which is not related through a priority claim, but has one of the same inventors) dated Dec. 3, 2009, 2 pages.

International Search Report and Written Opinion dated Mar. 21, 2012 from PCT/US2011/054280 (published as WO 2012/044968) which claims priority to the instant application; 9 pages.

* cited by examiner

LOW-PROFILE ANTENNA ASSEMBLIES

CROSS-REFERENCE TO RELATED APPLICATIONS

This application is a continuation-in-part of U.S. patent application Ser. No. 12/895,379 filed Sep. 30, 2010 (published Apr. 5, 2012 as US2012/0081253).

This application is also a continuation-in-part and claims priority to PCT International Application No. PCT/US2011/054280 filed Sep. 30, 2011 (published Apr. 5, 2012 as WO2012/044968), which, in turn, claims priority to U.S. patent application Ser. No. 12/895,379 filed Sep. 30, 2010.

This application is also a continuation-in-part and claims priority to PCT International Application No. PCT/US2012/06985 filed Dec. 14, 2012, which, in turn, claims priority to U.S. provisional patent application No. 61/570,534 filed Dec. 14, 2011.

The entire disclosures of the above four applications are incorporated herein by reference.

FIELD

The present disclosure generally relates to antenna assemblies, and more particularly to low-profile antenna assemblies suitable for use with mobile platforms such as, for example, automobiles, etc. where the antenna assemblies are mountable to roofs, hoods, trunks, etc. of the automobiles.

BACKGROUND

This section provides background information related to the present disclosure which is not necessarily prior art.

Various different types of antennas are used in the automotive industry, including AM/FM radio antennas, satellite digital audio radio service antenna, global positioning system antennas, cell phone antennas, etc. Such antennas are commonly placed on roofs, hoods, or trunks of automobiles to help ensure that the antennas have unobstructed views overhead or toward the zenith.

SUMMARY

This section provides a general summary of the disclosure, and is not a comprehensive disclosure of its full scope or all of its features.

Example embodiments of the present disclosure are generally directed toward antenna assemblies suitable for use with mobile platforms. In one example embodiment, an antenna assembly generally includes a chassis configured to be mounted on a mobile platform, a first antenna coupled to the chassis and configured for use with AM/FM radio, and a second antenna coupled to the chassis and configured for use with at least one or more of cell phones, satellite digital audio radio services, global positioning systems, Wi-Fi, Wi-Max, and digital audio broadcasting. The first antenna includes electrical conductors establishing a continuous electrical path around at least part of the first antenna and thereby defining an inductively loaded portion of the first antenna. And, an upper portion of the first antenna defines a capacitively loaded portion of the first antenna.

Example embodiments of the present disclosure are also generally directed toward low-profile antenna assemblies suitable for use with mobile platforms. In one example embodiment, an antenna assembly generally includes a chassis and at least two antennas co-located on the chassis. At least one of the at least two antennas located on the chassis includes an antenna operable at one or more frequencies ranging between about 140 kilohertz and about 110 megahertz. The antenna assembly has a height of about 60 millimeters or less.

Example embodiments of the present disclosure are also generally directed toward antennas configured for use with AM/FM radio. In one example embodiment, an antenna configured for use with AM/FM radio generally includes multiple electrical conductors located toward a first side surface of the antenna and multiple electrical conductors located toward an opposing second side surface of the antenna. The multiple electrical conductors are interconnected around at least part of the antenna to thereby establish a continuous electrical path around the at least part of the antenna and define an inductively loaded portion of the antenna.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments of the present disclosure are directed toward antenna assemblies comprising at least one antenna. Example antennas can include, but are not limited to, antennas configured for use with AM/FM radio, satellite digital audio radio services (SDARS) (e.g., Sirius XM, etc.), global positioning systems (GPS), global navigation satellite system (GLONASS), digital audio broadcasting (DAB)-VHF-III, DAB-L, Wi-Fi, Wi-Max, cellular phones, LTE (Long Term Evolution) frequencies (e.g., 4G, 3G, other LTE generation, B17 (LTE), LTE (700 MHz), etc.), etc.

In some example embodiments, the antenna assemblies include at least two antennas co-located, for example, on common chassis of the antenna assemblies, under common covers of the antenna assemblies, etc. In some example embodiments, the antenna assemblies define or are low-profile antenna assemblies in which heights of the antenna assemblies are lower than other antenna assemblies comprising similar combinations of antennas. In some example embodiments, the antenna assemblies have overall height dimensions of about 60 millimeters or less. And, in some of these example embodiments, the antenna assemblies have overall height dimensions of about 55 millimeters or less. Accordingly, exemplary embodiments are disclosed herein of multiband, low-profile antenna assembly suitable for use with mobile platforms and that are operable over multiple frequency bands.

Figure 1:
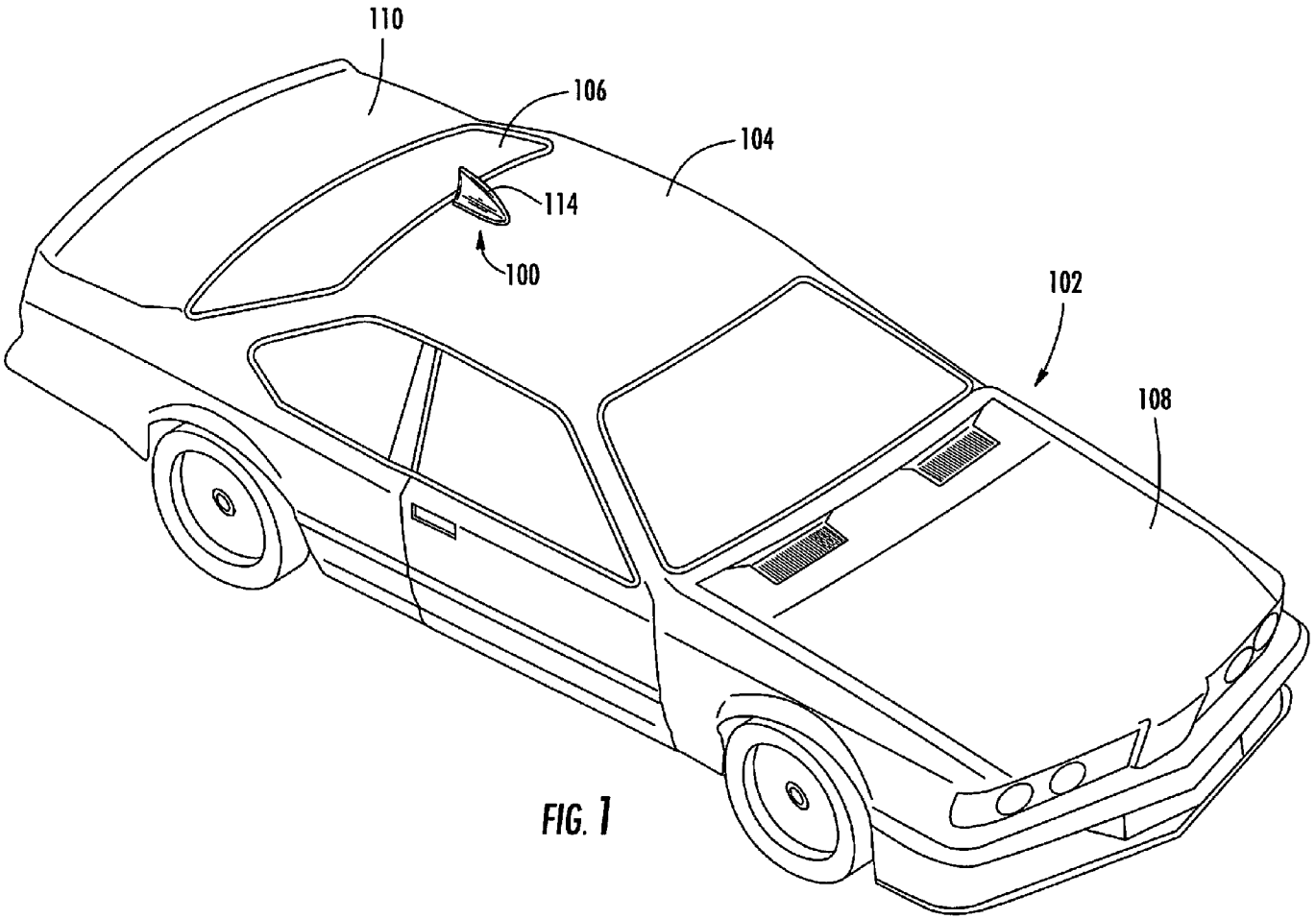
FIG. 1 is a perspective view of an example embodiment of an antenna assembly including at least one or more aspects of the present disclosure shown installed to a roof of a car.

With reference now to the drawings, FIGS. 1-7 illustrate an example embodiment of an antenna assembly 100 including at least one or more aspects of the present disclosure. FIG. 1 illustrates the antenna assembly 100 installed to a car 102 (broadly, a mobile platform). In particular, the antenna assembly 100 is shown mounted on a roof 104 of the car 102 toward a rear window 106 of the car 102 and along a longitudinal centerline of the roof 104. Here, the roof 104 of the car 102 acts as a ground plane for the antenna assembly 100. The antenna assembly 100 could, however, be mounted differently within the scope of the present disclosure. For example, the antenna assembly 100 could be mounted on a hood 108 or a trunk 110 of the car 102, etc. In addition, the antenna assembly 100 could be installed to a mobile platform other than the car 102, for example, a truck, a bus, a recreational vehicle, a boat, a vehicle without a motor, etc. within the scope of the present disclosure. U.S. Pat. No. 7,492,319 discloses example installations of antenna assemblies to vehicle bodies.

Figure 2:
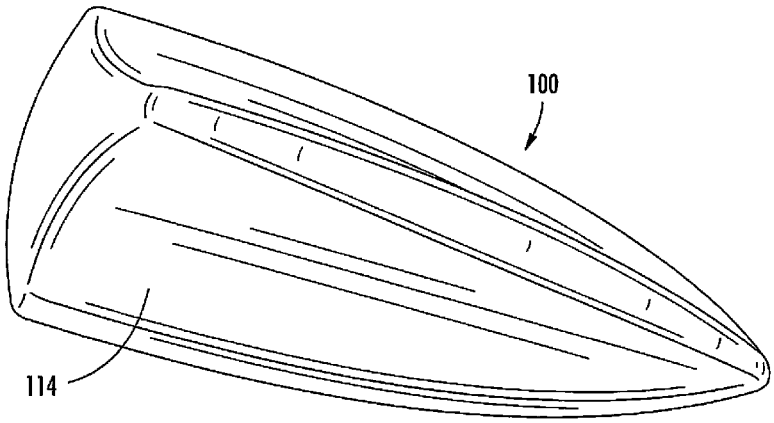
FIG. 2 is a perspective view of the antenna assembly of FIG. 1 shown removed from the car.
Figure 3:
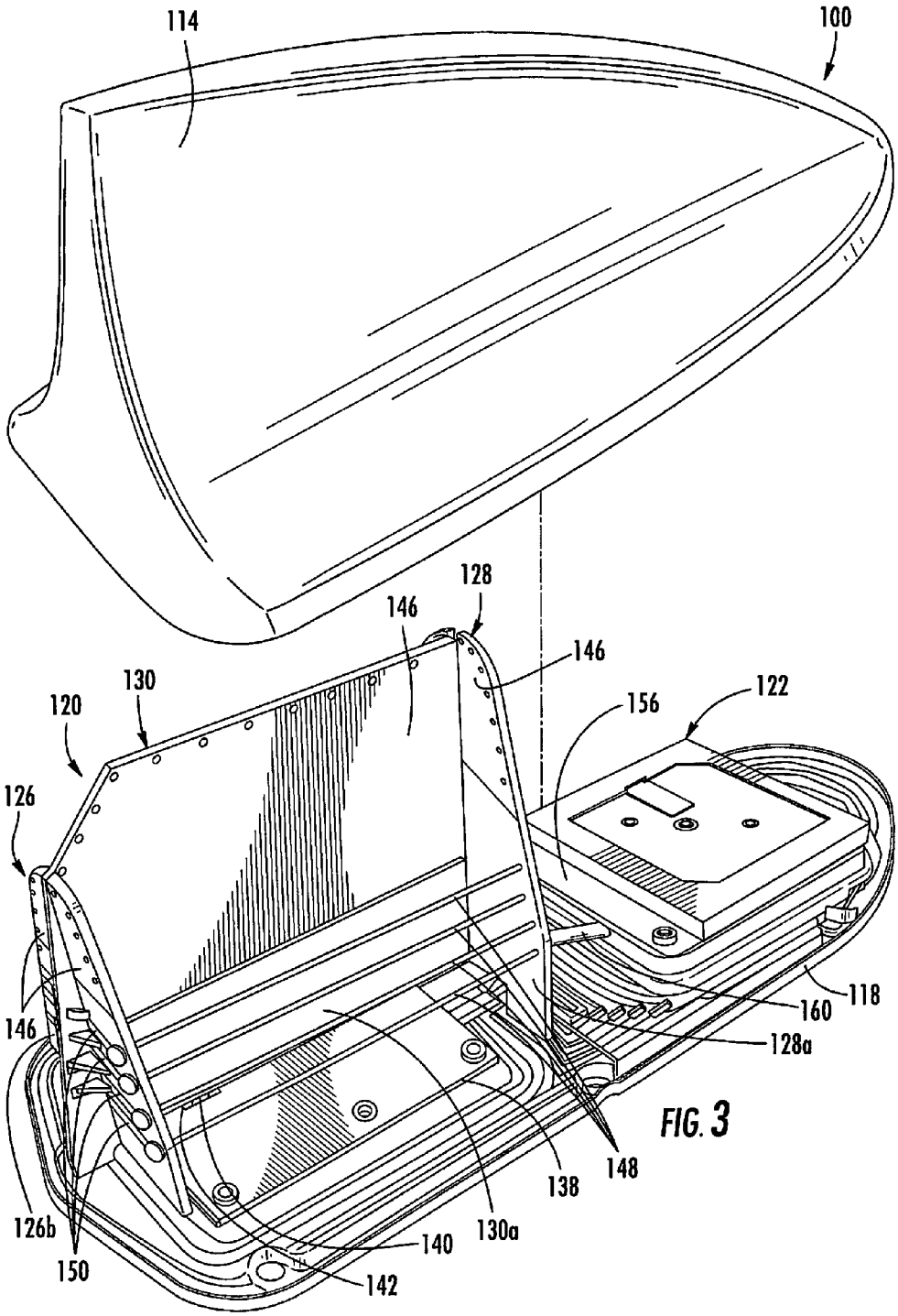
FIG. 3 is an exploded perspective view of the antenna assembly of FIG. 2.

With additional reference to FIGS. 2 and 3, the antenna assembly 100 includes a cover (or radome) 114 provided to help protect components of the antenna assembly 100 enclosed within the cover 114. For example, the cover 114 can substantially seal the components of the antenna assembly 100 within the cover 114 thereby protecting the components against ingress of contaminants (e.g., dust, moisture, etc.) into an interior enclosure of the cover 114. In addition, the cover 114 can provide an aesthetically pleasing appearance to the antenna assembly 100, and can be configured (e.g., sized, shaped, constructed, etc.) with an aerodynamic configuration. In the illustrated embodiment, for example, the cover 114 has an aesthetically pleasing, aerodynamic shark-fin configuration. In other example embodiments, however, antenna assemblies may include covers having configurations different than illustrated herein, for example, having configurations other than shark-fin configurations, etc. The cover 114 may also be formed from a wide range of materials, such as, for example, polymers, urethanes, plastic materials (e.g., polycarbonate blends, Polycarbonate-AcryInitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), etc. within the scope of the present disclosure.

As shown in FIG. 3, the antenna assembly 100 includes a chassis 118 (or base), and first and second antennas 120 and 122 coupled to the chassis 118 (and co-located on the chassis 118). The cover 114 is configured to fit over the first and second antennas 120 and 122 (such that the first and second antennas 120 and 122 can also be co-located under the cover 114) and secured to the chassis 118. And, the chassis 118 is configured to couple to the roof 104 of the car 102 for installing the antenna assembly 100 (and the antennas 120 and 122) to the car 102 (FIG. 1). The cover 114 may secure to the chassis 118 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc. Alternatively, the cover 114 may connect directly to the roof 104 of the car 102 within the scope of the present disclosure. The chassis 118 may be formed from materials similar to those used to form the cover 114. For example, the chassis 118 may be injection molded from polymer. Alternatively, the chassis 118 may be formed from steel, zinc, or other material (including composites) by a suitable forming process, for example, a die cast process, etc. within the scope of the present disclosure. U.S. Pat. No. 7,429,958 (Lindackers et al.) and U.S. Pat. No. 7,755,551 (Lindackers et al.) disclose example couplings between covers and chassis of antenna assemblies.

While not shown, a sealing member (e.g., an O-ring, a resiliently compressible elastomeric or foam gasket, etc.) may be provided between the chassis 118 and the roof 104 of the car 102 for substantially sealing the chassis 118 against the roof 104. A sealing member may also, or alternatively, be provided between the cover 114 of the antenna assembly 100 and the chassis 118 for substantially sealing the cover 114 against the chassis 118.

With additional reference to FIGS. 4-7, the first antenna 120 of the illustrated antenna assembly 100 is a vertical monopole antenna configured for use with AM/FM radio (e.g., configured for receiving/transmitting desired AM/FM radio signals, etc.). As illustrated, this AM/FM antenna 120 includes first and second spaced apart end flanges 126 and 128 and a web 130 positioned generally centrally between the end flanges 126 and 128. The end flanges 126 and 128 are oriented generally parallel to each other, and the web 130 is oriented generally perpendicular to the end flanges 126 and 128. Tab portions of the web 130 interconnect with corresponding slot portions of the end flanges 126 and 128 to help align the web 130 generally centrally between the end flanges 126 and 128, and solder is used to secure the web 130 and end flanges 126 and 128 together. In the illustrated embodiment, the end flanges 126 and 128 and the web 130 are arranged to define a generally English-language capital letter H shape (e.g., when viewed from above, etc.). The end flanges 126 and 128 and the web 130 can be constructed from any suitable material within the scope of the present disclosure including, for example, printed circuit board materials, double sided printed circuit board materials, etc. In other example embodiments, antenna assemblies can include AM/FM antennas defining shapes other than English-language capital letter H shapes within the scope of the present disclosure.

The AM/FM antenna 120 is coupled to the chassis 118 of the antenna assembly 100 at a first printed circuit board (PCB) 138 located toward a rearward portion of the chassis 118. The first PCB 138 can include any suitable PCB within the scope of the present disclosure including, for example, a double-sided PCB, etc. The illustrated first PCB 138 is fastened to the chassis 118 by mechanical fasteners, and the AM/FM antenna 120 (and particularly the web 130 of the AM/FM antenna 120) is soldered to the first PCB 138. Other means for coupling the first PCB 138 to the chassis 118 and/or for coupling the AM/FM antenna 120 to the first PCB 138 may be used within the scope of the present disclosure. The web 130 of the AM/FM antenna 120 also includes a downwardly extending projection 140 that is at least partially received within a corresponding opening 142 in the first PCB 138. The projection 140 can allow the AM/FM antenna 120 to make electrical connection through the opening 142 to a PCB component (not visible) on an opposite side of the first PCB 138 as desired.

Figure 4:
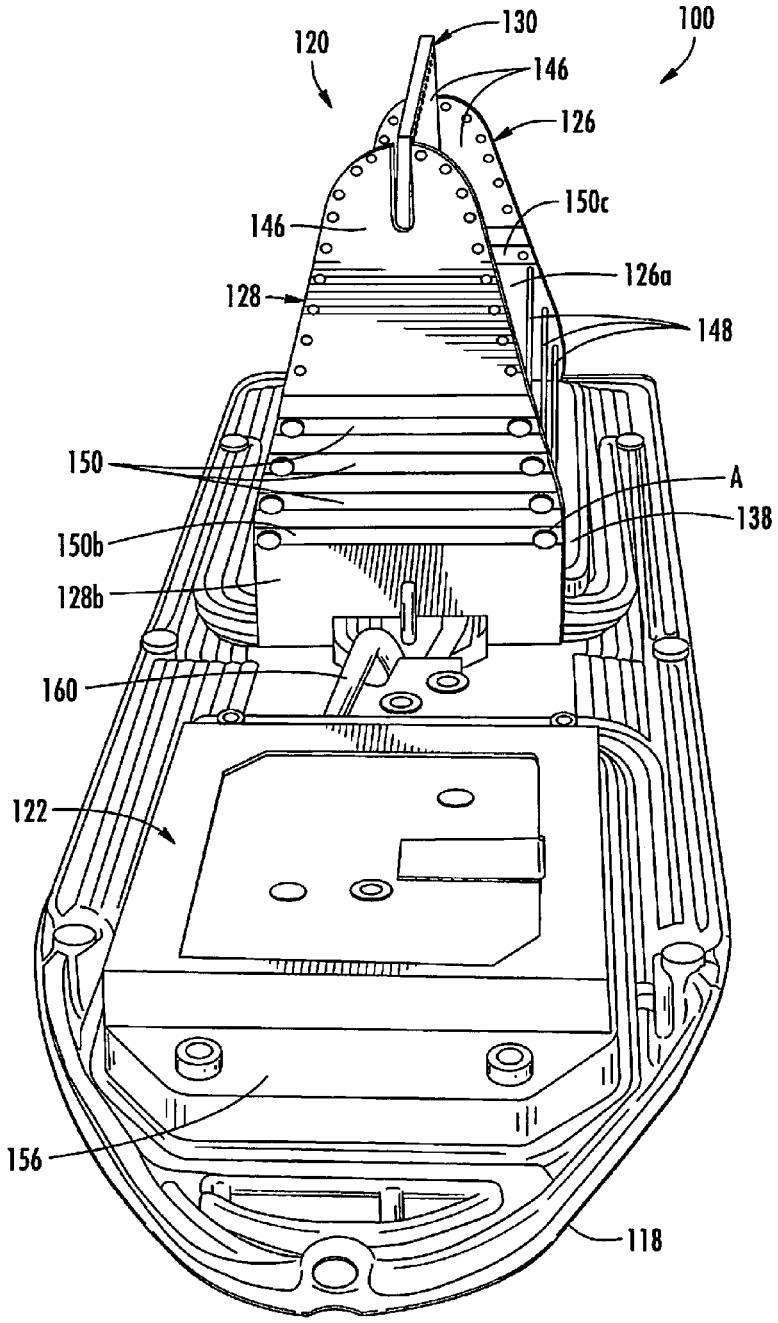
FIG. 4 is a forward perspective view of the antenna assembly of FIG. 2 with a cover of the antenna assembly removed.
Figure 5:
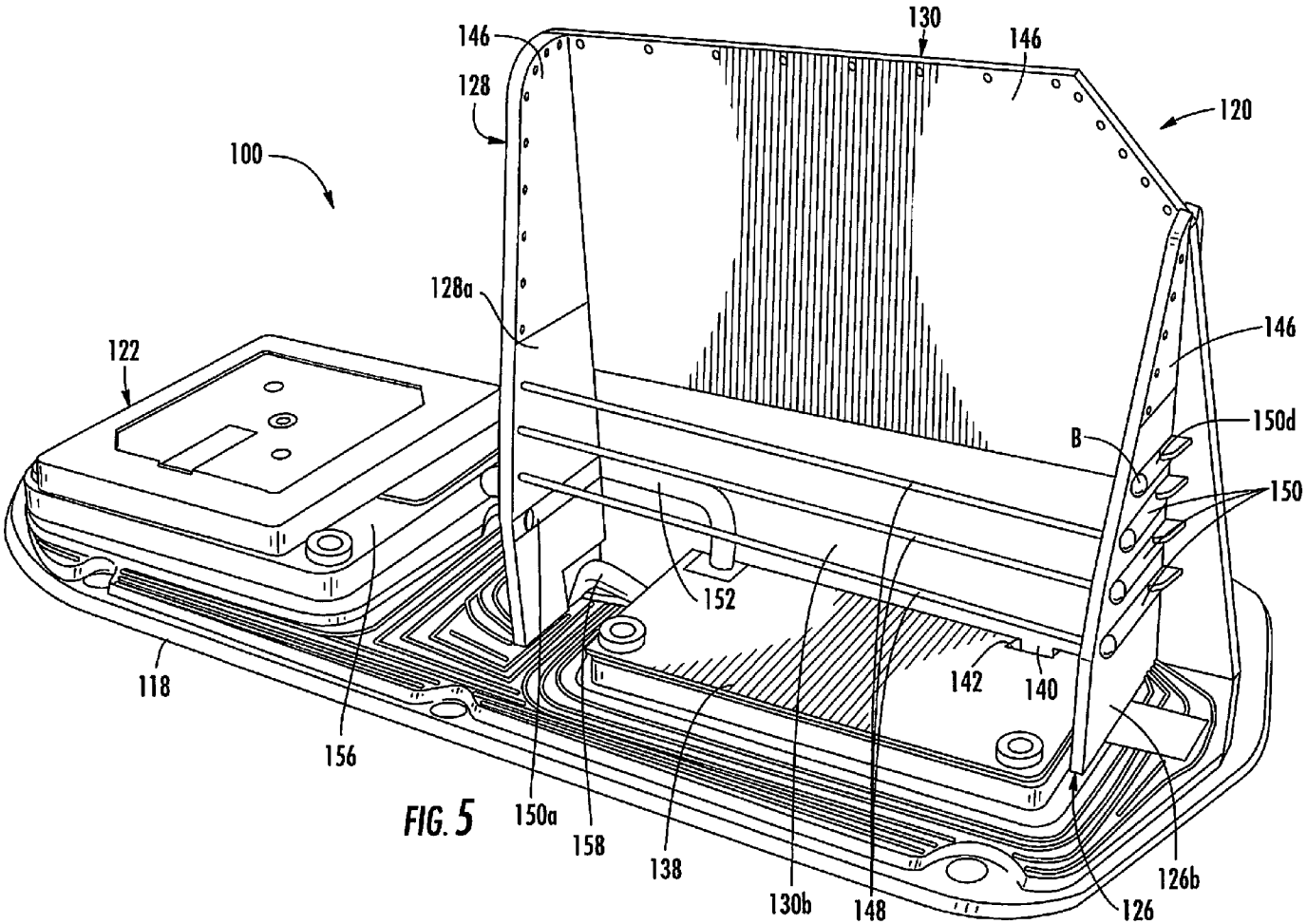
FIG. 5 is a right side perspective view of the antenna assembly of FIG. 4.
Figure 6:
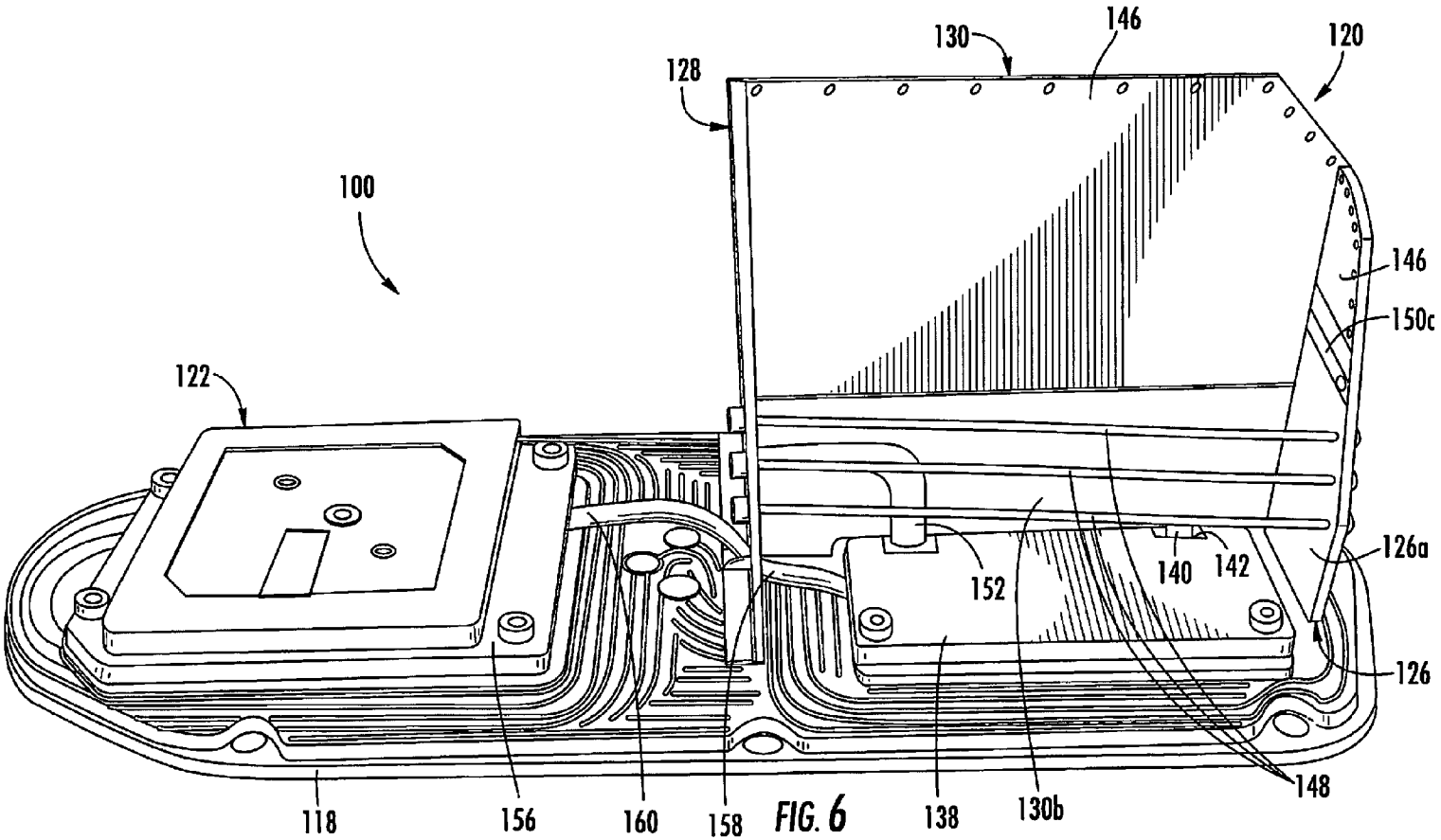
FIG. 6 is another right side perspective view of the antenna assembly of FIG. 4.
Figure 7:
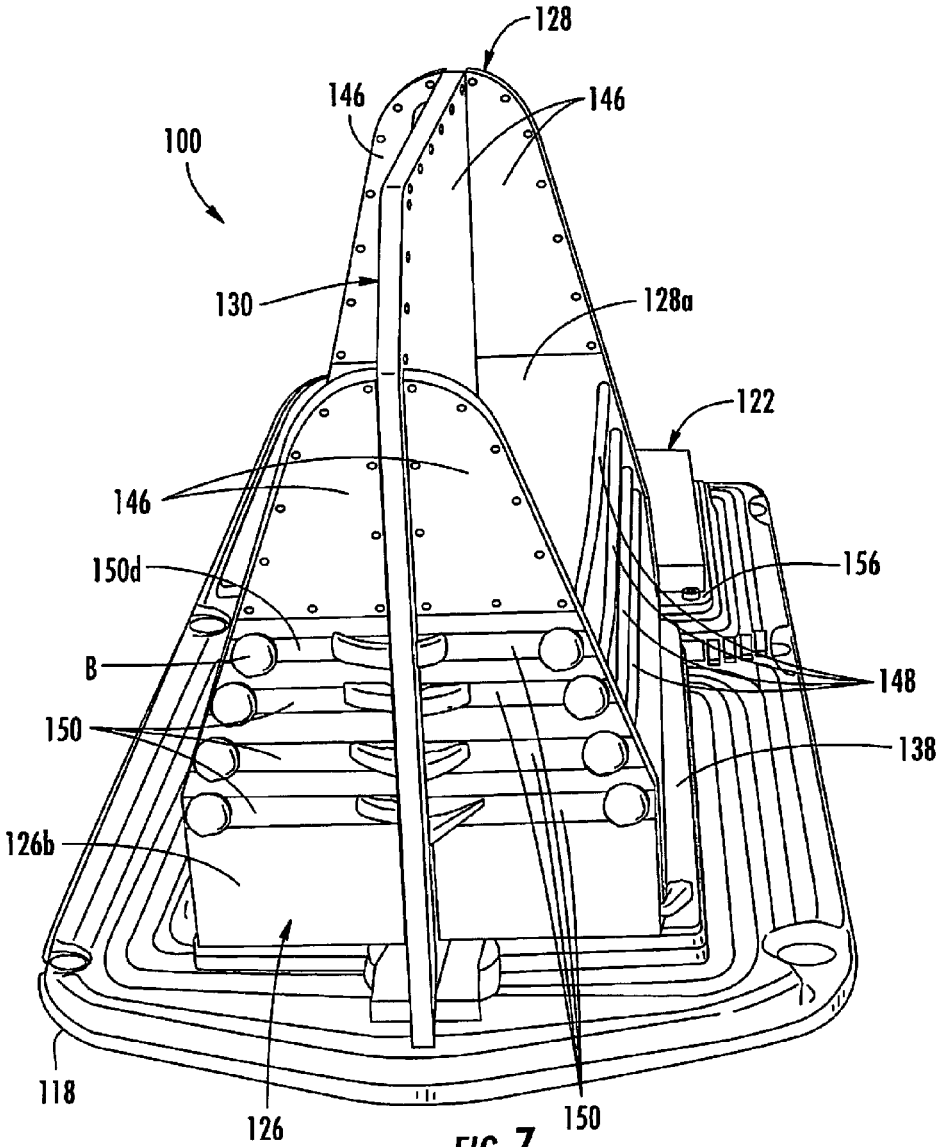
FIG. 7 is a rearward perspective view of the antenna assembly of FIG. 4.

Electrically conductive plating 146 is provided toward an upper portion of the AM/FM antenna 120 for capacitively loading the web 130 (e.g., an upper portion of the web 130, etc.) and an upper portion of the AM/FM antenna 120. This capacitive loading can help increase efficiency and bandwidth of the AM/FM antenna 120. For example, it can make the AM/FM antenna 120 appear electrically longer than its actual physical size, which is important in antennas that are relatively small in volume. The conductive plating 146 is coupled to upper portions of each of the end flanges 126 and 128 and the web 130 along portions of side surfaces of each of the end flanges 126 and 128 and the web 130. As such, the plating 146 on respective side surfaces is separated (and spaced apart) by the end flanges 126 and 128 and the web 130. The plating 146 can be made from any suitable electrically conductive material within the scope of the present disclosure including, for example, metallic materials such as copper, etc., or other electrically conductive materials, etc. In addition, the plating 146 can be arranged (e.g., located, shaped, etc.) as desired within the scope of the present disclosure (e.g., a portion of the cover 114 could include the plating 146 and could provide capacitive loading of the AM/FM antenna 120, etc.), In addition, electrical conductors 148 are provided toward a lower portion of the AM/FM antenna 120 (and toward a lower portion of the web 130) for inductively loading the lower portion of the AM/FM antenna 120. This inductive loading can help increase efficiency and bandwidth of the AM/FM antenna 120. For example, it can make the AM/FM antenna 120 appear electrically longer than its actual physical size. In the illustrated embodiment, four electrical conductors 148 are located toward a first side surface 130*a* of the web 130 (FIG. 3), and three electrical conductors 148 are located toward a second side surface 130*b* of the web 130 (FIGS. 5 and 6). The electrical conductors 148 are oriented generally parallel to each other and extend between the first and second end flanges 126 and 128. The electrical conductors 148 are also oriented generally parallel to the web 130. End portions of the electrical conductors 148 extend through the end flanges 126 and 128 and connect to electrically conductive traces 150 (e.g., PCB material traces, etc.) disposed along (e.g., soldered to, etc.) outer side surfaces 126*b* and 128*b* of the end flanges 126 and 128 (FIGS. 4 and 7). Traces 150 along the outer side surface 126*b* of the first end flange 126 are electrically coupled together as desired (e.g., via soldering, etc.) across the portion of the web 130 extending through the first end flange 126 (FIGS. 3, 5, and 7). As such, the electrical conductors 148 and the traces 150 define a continuous, generally rectangular shaped, electrical path generally coiling around the AM/FM antenna 120 (e.g., around the web 130 and the end flanges 126 and 128 generally clockwise in the illustrated embodiment, etc.). The electrical conductors 148 and/or the traces 150 can be made from any suitable electrically conductive material within the scope of the present disclosure including, for example, metallic materials such as copper, etc., or other electrically conductive materials, etc. In addition, the electrical conductors 148 can be shaped as desired including, for example, as wires, strips, traces, etc.

In other example embodiments, antenna assemblies can include AM/FM antennas in which inductively loaded portions of the AM/FM antennas include single electrical conductors continuously wrapped around the AM/FM antennas as desired. In other example embodiments, antenna assemblies can include AM/FM antennas in which inductively loaded portions of the AM/FM antennas include additional printed circuit boards extending between end flanges of the AM/FM antennas (e.g., generally parallel to webs of the AM/FM antennas, etc.) with electrically conductive traces located on the additional printed circuit boards and aligned with corresponding electrically conductive traces located on the end flanges to thereby generally define an electrical path around the AM/FM antennas. In other example embodiments, antenna assemblies can include AM/FM antennas in which inductively loaded portions of the AM/FM antennas include electrical conductors (e.g., electrical conductors and traces, single electrical conductors, traces, etc.) defining shapes other than generally rectangular (e.g., generally circular shapes, generally oval shapes, generally square shapes, any suitable large diameter coil shape, any suitable shape other than generally a round shape, any other suitable configuration, etc.). In other example embodiments, antenna assemblies can include AM/FM antennas in which capacitively loaded portions of the AM/FM antennas define configurations other than disclosed herein (e.g., suitable configurations wherein the capacitively loaded portions do not shield inductively loaded portions of the AM/FM antennas, etc.).

A coupling wire 152 electrically connects the first PCB 138 (e.g., at a feed point on the first PCB 138, etc.) to the AM/FM antenna 120. In particular, the coupling wire 152 connects to a lower trace 150*a* mounted (e.g., fastened, etc.) on an inner side surface 128*a* of the second end flange 128. This lower trace 150*a* is electrically coupled to a corresponding trace 150*b* located on the outer side surface 128*b* of the second end flange 128 (at a location adjacent point A identified in FIG. 4). This electrically connects the first PCB 138 to the electrical conductors 148 (and the AM/FM antenna 120) via interconnection of the electrical conductors 148 and the traces 150. In addition, an upper trace 150*c* mounted on an inner side surface 126*a* of the first end flange 126 is soldered to the plating 146 on the second side surface 130*b* of the web 130. This upper trace 150*c* is electrically coupled to a corresponding trace 150*d* located on the outer side surface 126*b* of the first end flange 126 (at a location adjacent point B identified in FIG. 5). This electrically connects the first PCB 138 to the plating 146 (via the coupling wire 152, the traces 150, and the electrical conductors 148). As such, the plating 146 on the web 130 acts as one half of a capacitor (e.g., as one conductive plate, etc.) and the ground under the AM/FM antenna 120 acts as the other half of the capacitor (as another conductive plate, etc.), with air therebetween acting as a separating insulator. Thus, the illustrated AM/FM antenna 120 can be viewed as one long conductor extending from the coupling wire 152 at the first PCB 138 to the capacitively loaded upper portion of the AM/FM antenna 120 (e.g., the plating 146 of the web 130, etc.), with the inductively loaded portion of the AM/FM antenna 120 (e.g., the coil portion defined by the traces 150 and the electrical conductors 148 extending between them, etc.) located therebetween.

The AM/FM antenna 120 may be operable at one or more frequencies including, for example frequencies ranging between about 140 Kilohertz (KHz) and about 110 Megahertz (MHz), etc. For example, the illustrated AM/FM antenna 120 can be resonant in the FM band (e.g., at frequencies between about 88 MHz and about 108 MHz, etc.) and can also work at AM frequencies, but may not be resonant at various AM frequencies (e.g., frequencies between about 535 KHz and about 1735 KHz, etc.). The AM/FM antenna 120 may also be tuned as desired for operation at desired frequency bands by, for example, adjusting dimensions of the end flanges 126 and 128 and/or the web 130, adjusting dimensions of the plating 146 provided toward the upper portion of the AM/FM antenna 120, adjusting size and/or number of electrical conductors 148 provided toward the lower portion of the AM/FM antenna 120, etc. For example, the AM/FM antenna 120 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

With continued reference to FIGS. 4-7, the second antenna 122 of the illustrated antenna assembly 100 is a patch antenna configured for use with satellite digital audio radio services (SDARS) (e.g., Sirius XM Satellite Radio, etc.) (e.g., configured for receiving/transmitting desired SDARS signals, etc.). In the illustrated embodiment, this SDARS antenna 122 is coupled to the chassis 118 at a second PCB 156 located toward a forward portion of the chassis 118. The second PCB 156 can include any suitable PCB within the scope of the present disclosure including, for example, a double-sided PCB, etc. The second PCB 156 is fastened to the chassis 118 by mechanical fasteners, and the SDARS antenna 122 is electrically coupled to the second PCB 156 as desired and fastened thereto by a mechanical fastener. Other means for coupling the second PCB 156 to the chassis 118 and/or for coupling the SDARS antenna 122 to the second PCB 156 may be used within the scope of the present disclosure.

The SDARS antenna 122 may be operable at one or more desired frequencies including, for example, frequencies ranging between about 2,320 MHz and about 2,345 MHz, etc. The SDARS antenna 122 may also be tuned as desired for operation at desired frequency bands by, for example, changing dielectric materials, changing sizes of metal plating, etc. used in connection with the SDARS antenna 122, etc.

An electrical connector (not visible) may be attached to the first PCB 138 via cable 158 and the second PCB 156 via cable 160 for coupling the antenna assembly 100 to a suitable communication link (e.g., a coaxial cable, etc.) in the car 102 (e.g., through an opening in the chassis 118 aligned with an opening in the roof 104 of the car 102, etc.). In this way, the first and/or second PCB 138 and/or 156 may receive signal inputs from the AM/FM and/or SDARS antennas 120 and/or 122, process the signal inputs, and transmit the processed signal inputs to the suitable communication link. Alternatively, or in addition, the first and/or second PCB 138 and/or 156 may process signal inputs to be transmitted via or through the AM/FM and/or SDARS antennas 120 and/or 122. With this said, it is understood that that the AM/FM and/or SDARS antennas 120 and/or 122 may receive and/or transmit radio signals as desired.

In some example embodiments, the electrical connector may be an ISO (International Standards Organization) standard electrical connector or a Fakra connector attached to the first PCB 138 via the cable 158 and the second PCB 156 via the cable 160. Accordingly, a coaxial cable (or other suitable communication link) may be relatively easily connected to the electrical connector and used for communicating signals received by the AM/FM and/or SDARS antennas 120 and/or 122 to another device, such as a radio receiver, etc. in the car 102. In such embodiments, the use of standard ISO electrical connectors or Fakra connectors may allow for reduced costs as compared to those antenna installations that require a customized design and tooling for the electrical connection between the antenna assembly 100 and cable. In addition, the pluggable electrical connections between the communication link and the electrical connector may be accomplished by the installer without the installer having to complexly route wiring or cabling through body walls of the car 102. Accordingly, the pluggable electrical connection may be easily accomplished without requiring any particular technical and/or skilled operations on the part of the installer. Alternative embodiments may include using other types of electrical connectors and communication links (e.g., pig tail connections, etc.) besides standard ISO electrical connectors, Fakra connectors, and coaxial cables.

Figure 8:
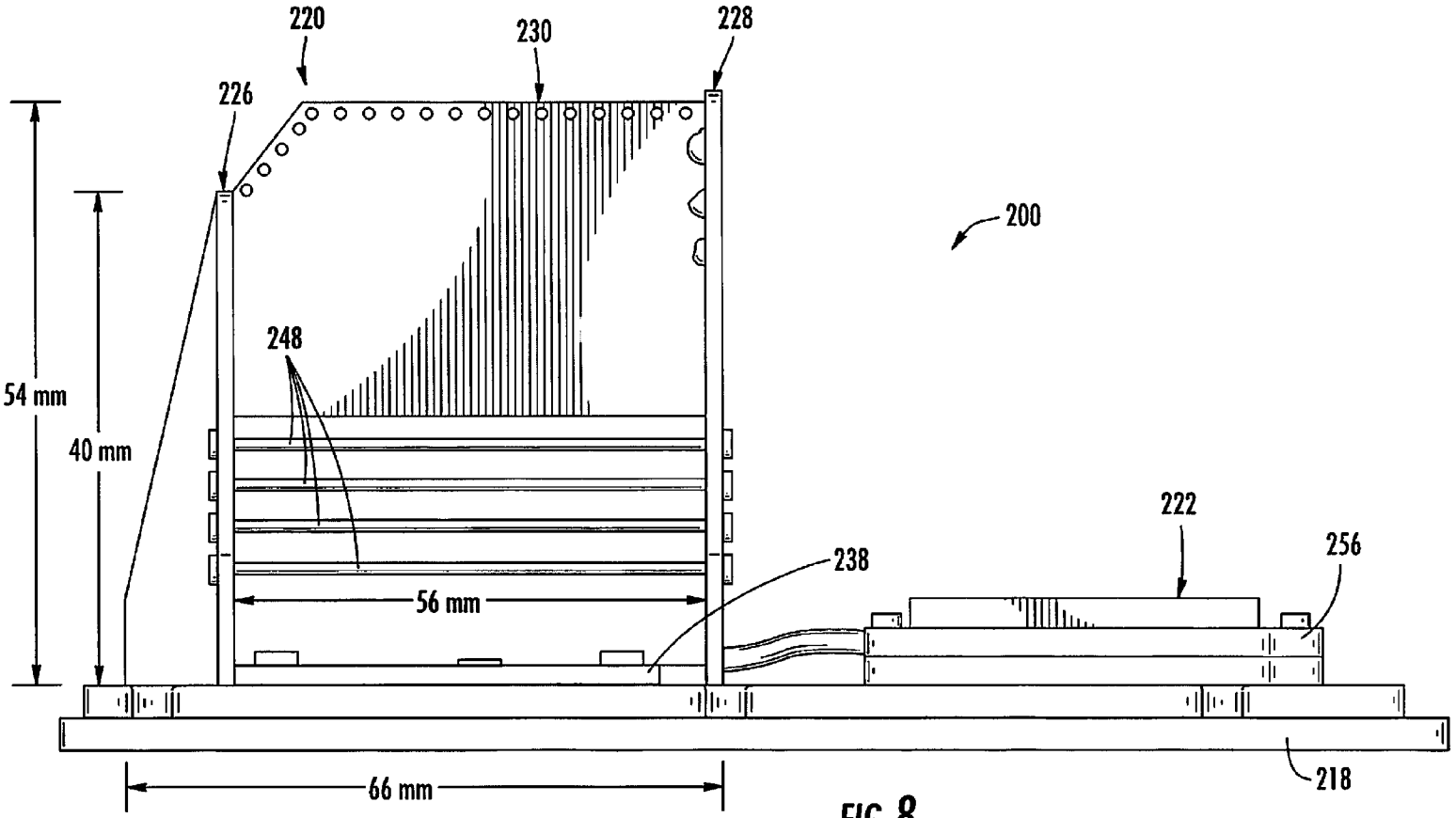
FIG. 8 is a side elevation view of an example embodiment of an antenna assembly including at least one or more aspects of the present disclosure with a cover of the antenna assembly removed.
Figure 9:
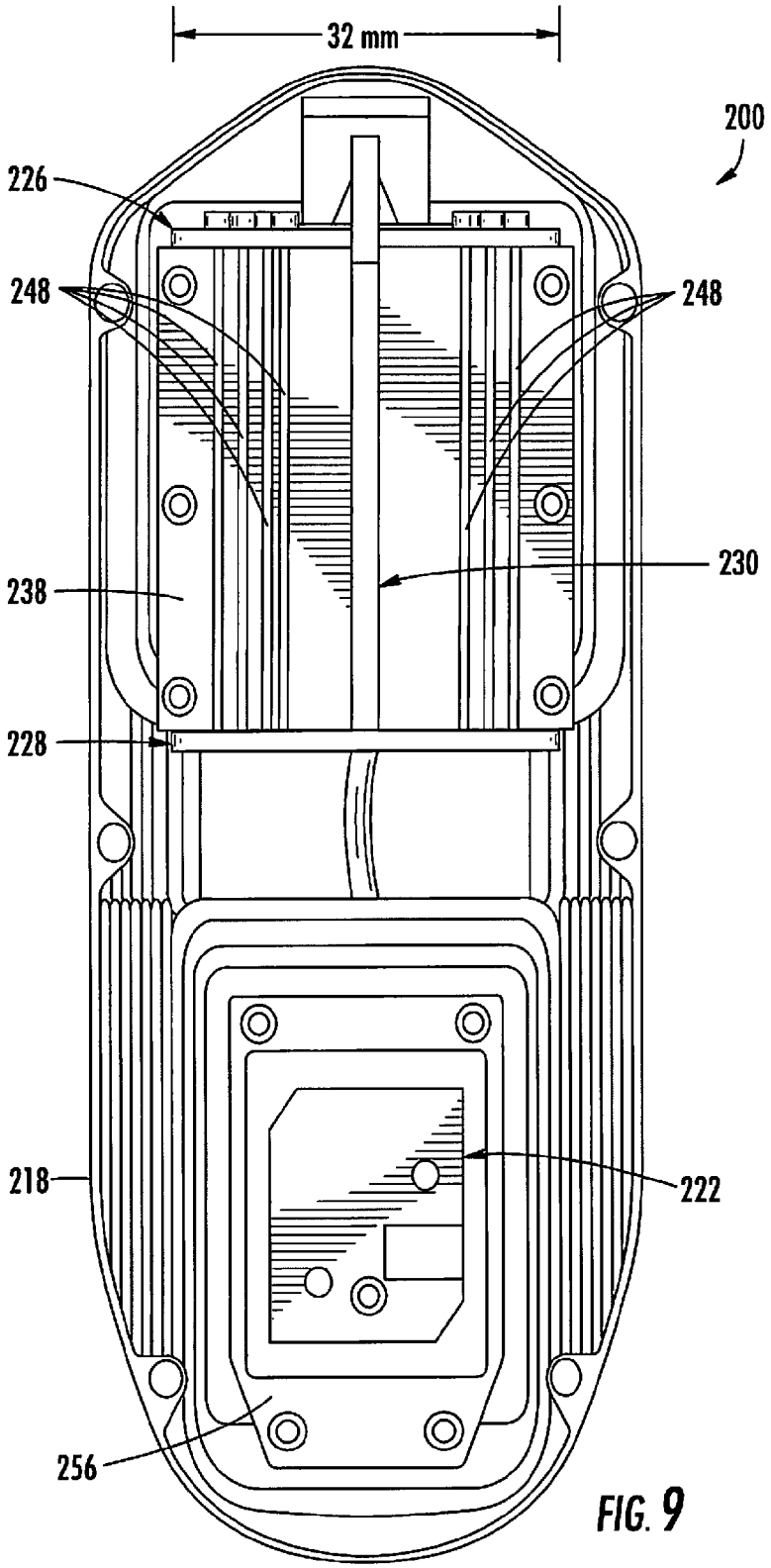
FIG. 9 is a top plan view of the antenna assembly of FIG. 8.

FIGS. 8 and 9 illustrate another example embodiment of an antenna assembly 200 including at least one or more aspects of the present disclosure. The antenna assembly 200 of this embodiment is substantially the same as the antenna assembly 100 previously described and illustrated in FIGS. 1-7. For example, the antenna assembly 200 of this embodiment includes a chassis 218, and first and second antennas 220 and 222 coupled to the chassis 218. The first antenna 220 (coupled to the chassis 218 by a first PCB 238) is a vertical monopole antenna configured for use with AM/FM radio, and the second antenna 222 (coupled to the chassis 218 by a second PCB 256) is a patch antenna configured for use with SDARS. The AM/FM antenna 220 includes first and second spaced apart end flanges 226 and 228 and a web 230 positioned generally centrally between the end flanges 226 and 228.

In this embodiment, example dimensions of the AM/FM antenna 220, including the end flanges 226 and 228 and the web 230, are provided in FIGS. 8 and 9. For example, in this embodiment a height of the AM/FM antenna 220 is about 54 millimeters, a length of the AM/FM antenna 220 is about 66 millimeters, and a width of the AM/FM antenna 220 is about 32 millimeters. As such, the first and second end flanges 226 and 228 are spaced apart a distance of about 56 millimeters, and electrical conductors 248 positioned between the first and second end flanges 226 and 228 have lengths of about 61 millimeters. In addition, the web 230 has a height of about 54 millimeters and a length of about 66 millimeters, the second end flange 228 has a height of about 54 millimeters and a width of about 32 millimeters, and the first end 226 has a height of about 40 millimeters and a width of about 32 millimeters.

As can be seen from the example dimensions, the illustrated AM/FM antenna 220, and thus the illustrated antenna assembly 200 including the AM/FM antenna 220, has a relatively low-profile (as compared, for example, to other AM/FM antennas and antenna assemblies including AM/FM antennas). For example, in this embodiment the AM/FM antenna 220 has a height of about 54 millimeters and defines a footprint having a length of about 66 millimeters and a width of about 32 millimeters. In other example embodiments, antenna assemblies can include AM/FM antennas having heights of about 55 millimeters or less and defining footprints having lengths of about 66 millimeters or less and widths of about 30 millimeters or less. In other example embodiments, antenna assemblies can include AM/FM antennas having other dimensions within the scope of the present disclosure.

Figure 10:
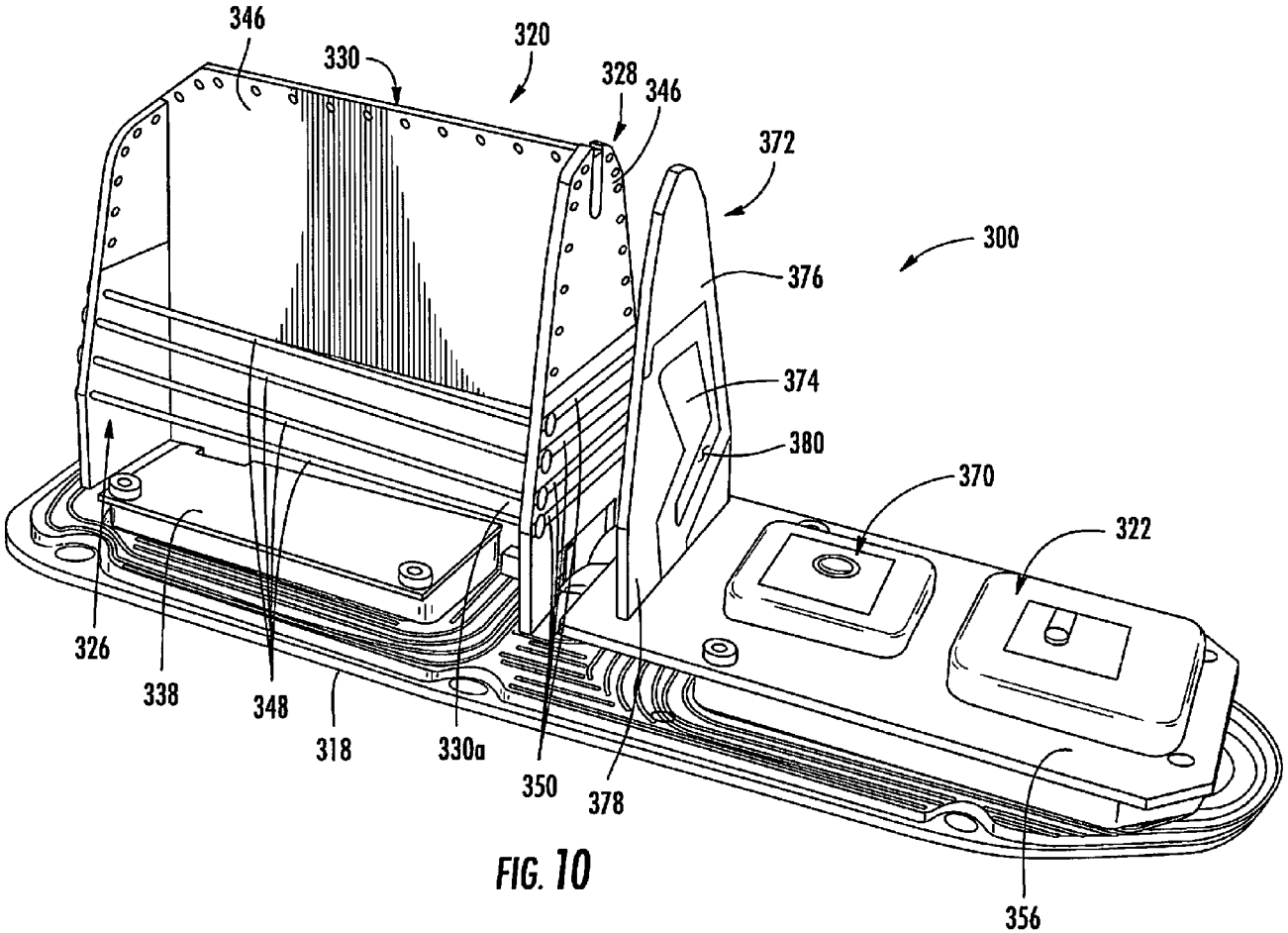
FIG. 10 is a left side perspective view of an example embodiment of an antenna assembly including at least one or more aspects of the present disclosure with a cover of the antenna assembly removed.
Figure 11:
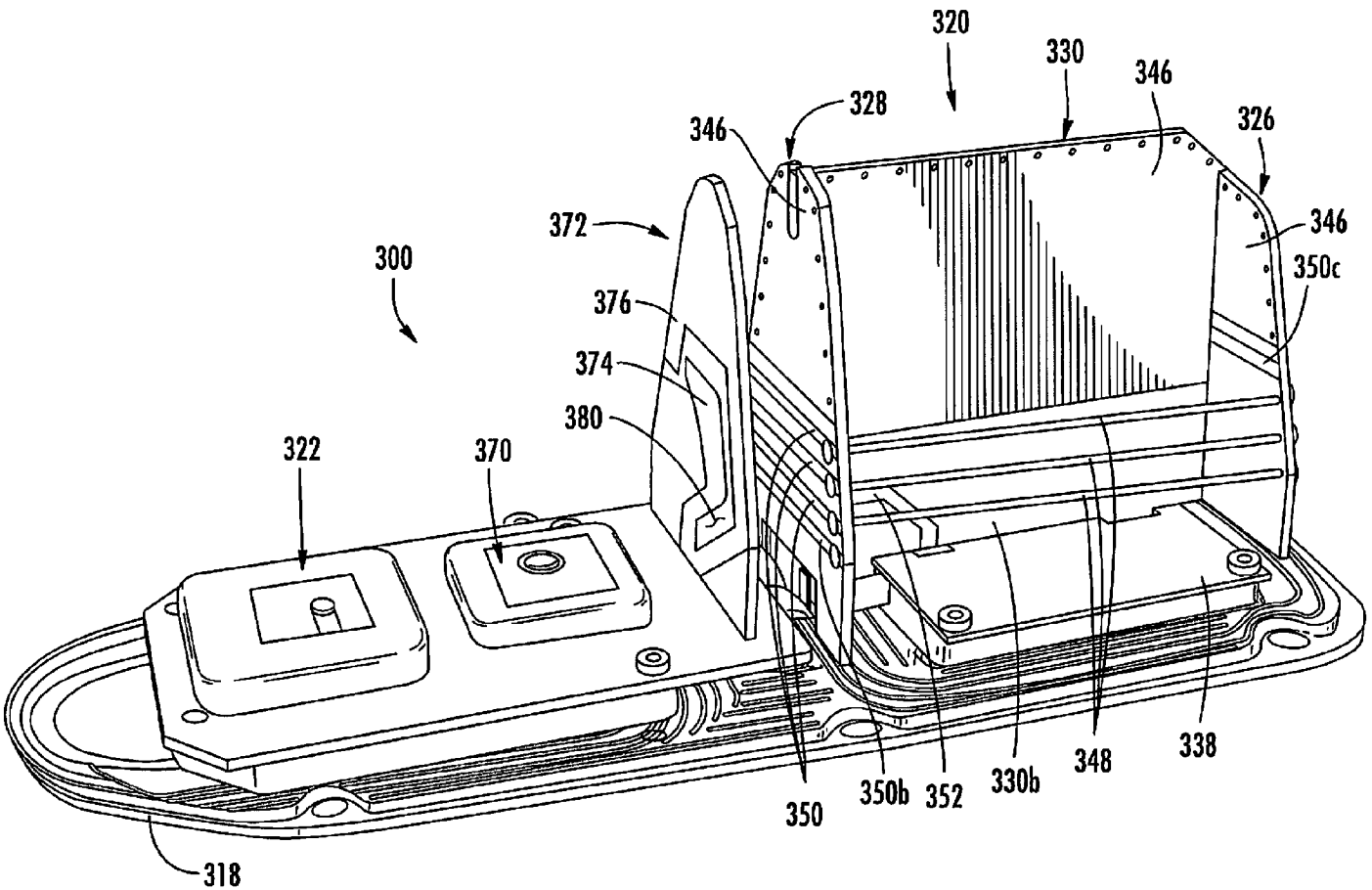
FIG. 11 is a right side perspective view of the antenna assembly of FIG. 10.
Figure 12:
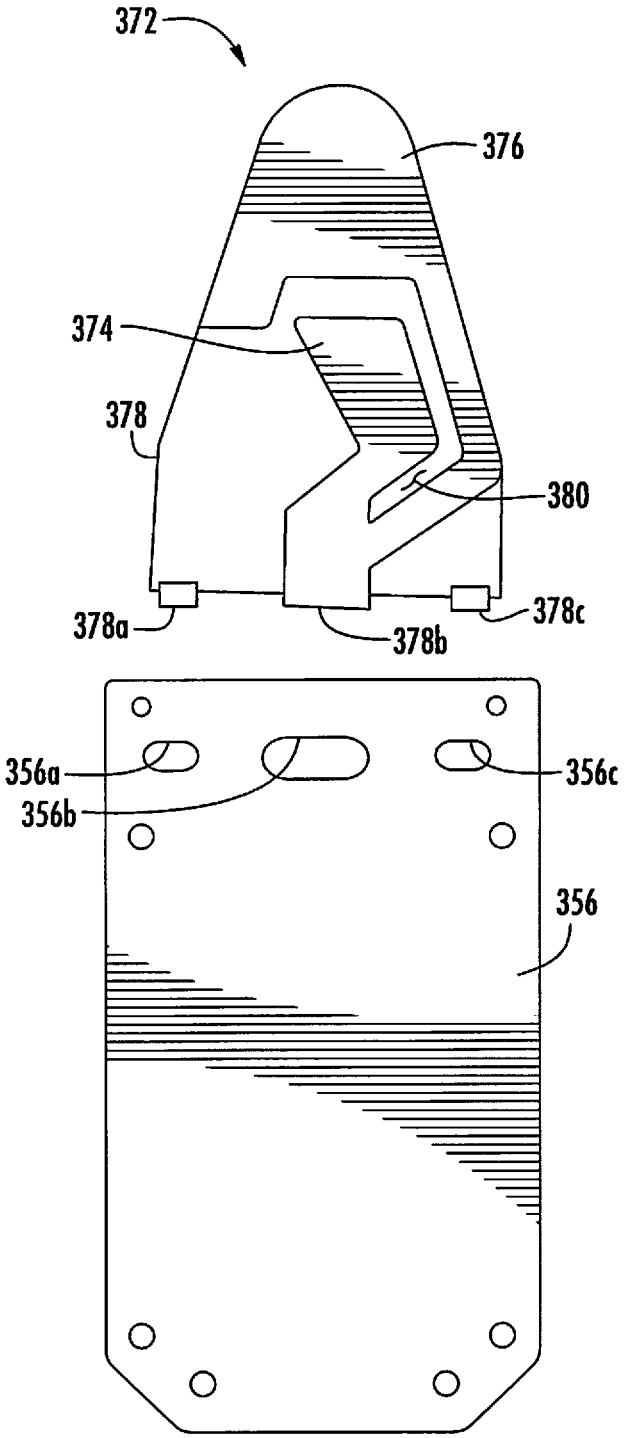
FIG. 12 is a top plan view of an antenna of the antenna assembly of FIG. 10 configured for use with cell phones and shown adjacent a second printed circuit board of the antenna assembly of FIG. 10.

FIGS. 10-12 illustrate another example embodiment of an antenna assembly 300 including at least one or more aspects of the present disclosure. The antenna assembly 300 of this embodiment is similar to the antenna assembly 100 previously described and illustrated in FIGS. 1-7. For example, the antenna assembly 300 of this embodiment includes a chassis 318 configured to couple the antenna assembly 300 to a mobile platform, and first and second antennas 320 and 322 coupled to the chassis 318. In addition in this embodiment, the antenna assembly 300 includes third and fourth antennas 370 and 372 coupled to the chassis 318 (with each of the first, second, third, and fourth antennas 320, 322, 370, and 372 co-located on the chassis 318).

The first antenna 320 of the illustrated antenna assembly 300 is a vertical monopole antenna configured for use with AM/FM radio (e.g., configured for receiving/transmitting desired AM/FM radio signals, etc.). This AM/FM antenna 320 is coupled to the chassis 318 of the antenna assembly 300 at a first PCB 338 located toward a rearward portion of the chassis 318. The first PCB 338 is fastened to the chassis 318 by mechanical fasteners, and the AM/FM antenna 320 is soldered to the first PCB 338. The illustrated AM/FM antenna 320 includes first and second spaced apart end flanges 326 and 328 and a web 330 positioned generally centrally between the end flanges 326 and 328. The end flanges 326 and 328 are oriented generally parallel to each other, and the web 330 is oriented generally perpendicular to the end flanges 326 and 328. Tab portions of the web 330 interconnect with corresponding slot portions of the end flanges 326 and 328 to help align the web 330 generally centrally between the end flanges 326 and 328, and solder is used to secure the web 330 and end flanges 326 and 328 together. In the illustrated embodiment, the end flanges 326 and 328 and the web 330 are arranged to define a generally English-language capital letter H shape.

Electrically conductive plating 346 is provided toward an upper portion of the AM/FM antenna 320 for capacitively loading the web 330 (e.g., an upper portion of the web 330, etc.) and an upper portion of the AM/FM antenna 320. In particular, the plating 346 is coupled to upper portions of each of the end flanges 326 and 328 and the web 330 along opposing side surfaces of each of the end flanges 326 and 328 and the web 330.

In addition, electrically conductive electrical conductors 348 are provided toward a lower portion of the AM/FM antenna 320 (and toward a lower portion of the web 330) for inductively loading the lower portion of the AM/FM antenna 320. In the illustrated embodiment, four electrical conductors 348 are located toward a first side surface 330*a* of the web 330 (FIG. 10), and three electrical conductors 348 are located toward a second side surface 330*b* of the web 330 (FIG. 11). The electrical conductors 348 are oriented generally parallel to each other and extend between the first and second end flanges 326 and 328. The electrical conductors 348 are also oriented generally parallel to the web 330. End portions of the electrical conductors 348 extend through the end flanges 326 and 328 and connect to electrically conductive traces 350 disposed along (e.g., soldered to, etc.) outer side surfaces of the end flanges 326 and 328. As such, the electrical conductors 348 and the traces 350 define a continuous, generally rectangular shaped, electrical path generally coiling around the AM/FM antenna 320 (e.g., around the web 330 and the end flanges 326 and 328 generally clockwise in the illustrated embodiment, etc.).

A coupling wire 352 electrically connects the first PCB 338 to the AM/FM antenna 320 (in similar fashion to the coupling wire 152 of the AM/FM antenna 120 illustrated in FIGS. 3-7). In particular, the coupling wire 352 connects to a lower trace (not visible) mounted (e.g., fastened, etc.) on an inner side surface of the second end flange 328. This lower trace 350*a* is electrically coupled to a corresponding trace 350*b* located on an outer side surface of the second end flange 328. This electrically connects the first PCB 338 to the electrical conductors 348 (and the AM/FM antenna 320) via interconnection of the electrical conductors 348 and the traces 350, thereby defining an inductively loaded portion of the AM/FM antenna 320. In addition, an upper trace 350*c* mounted on an inner side surface of the first end flange 326 is soldered to the plating 346 on the second side surface 330*b* of the web 330. This upper trace 350*c* is electrically coupled to a corresponding trace (not visible) located on an outer side surface of the first end flange 326. This electrically connects the first PCB 338 to the plating 346 (via the traces 350 and electrical conductors 348), thereby defining a capacitively loaded portion of the AM/FM antenna 320.

The AM/FM antenna 320 may be operable at one or more frequencies including, for example frequencies ranging between about 140 KHz and about 110 MHz, etc. For example, the illustrated AM/FM antenna 320 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM antenna 320 may also be tuned as desired for operation at desired frequency bands by, for example, adjusting dimensions of the end flanges 326 and 328 and/or the web 330, adjusting dimensions of the plating 346 provided toward the upper portion of the AM/FM antenna 320, adjusting size and/or number of electrical conductors 348 provided toward the lower portion of the AM/FM antenna 320, etc. For example, the AM/FM antenna 120 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

The second antenna 322 of the illustrated antenna assembly 300 is a patch antenna configured for use with SDARS (e.g., configured for receiving/transmitting desired SDARS signals, etc.). This SDARS antenna 322 is coupled to the chassis 318 at a second PCB 356 located toward a forward portion of the chassis 318. The second PCB 356 is fastened to the chassis 318 by mechanical fasteners, and the SDARS antenna 322 is electrically coupled to the second PCB 356 as desired and fastened thereto by a mechanical fastener. The SDARS antenna 322 may be operable at one or more desired frequencies including, for example, frequencies ranging between about 2,320 MHz and about 2,345 MHz, etc. The SDARS antenna 322 may also be tuned as desired for operation at desired frequency bands by, for example, changing dielectric materials, changing sizes of metal plating, etc. used in connection with the SDARS antenna 322, etc.

The third antenna 370 is a patch antenna configured for use with global positioning systems (GPS) (e.g., configured for receiving/transmitting desired GPS signals, etc.). This GPS antenna 370 is coupled to the chassis 318 via the second PCB 356 at a location adjacent the SDARS antenna 322. Alternatively, the GPS antenna 370 could be stacked with the SDARS antenna 322 (one on top of the other) on the second PCB 356. The GPS antenna 370 is electrically coupled to the second PCB 356 as desired and fastened thereto, for example, by a mechanical fastener, etc. As such, the SDARS antenna 322 and the GPS antenna 370 are co-located on the second PCB 356. The GPS antenna 370 may be operable at one or more desired frequencies including, for example, frequencies ranging between about 1,574 MHz and about 1,576 MHz, etc. And, the GPS antenna 370 may also be tuned as desired for operation at desired frequency bands by, for example, changing dielectric materials, changing sizes of metal plating, etc. used in connection with the GPS antenna 370, etc.

The fourth antenna 372 is a vertical monopole antenna configured for use with cell phones (e.g., for receiving/transmitting desired cell phone signals, etc.). This cell phone antenna 372 is coupled to the chassis 318 at the second PCB 356 at a location adjacent the SDARS antenna 322. In particular, a base 378 of the cell phone antenna 372 couples to the second PCB 356. As shown in FIG. 12, tabs 378*a-c* of the base 378 are configured to fit in corresponding openings 356*a-c* defined in the second PCB 356 and then be soldered to the second PCB 356 (for supporting the cell phone antenna 372 generally above the second PCB 356). As such, the SDARS antenna 322, the GPS antenna 370, and the cell phone antenna 372 co-located on the second PCB 356.

The cell phone antenna 372 includes first and second conductors 374 and 376 (or radiating elements) positioned along the base 378, which is generally vertically oriented relative to the second PCB 356. The first and second conductors 374 and 376 are soldered to the second PCB 356 at the central tab 378*b* of the base 378 for electrically connecting the cell phone antenna 372 to the second PCB 356. The first and second conductors 374 and 376 are oriented such that the first conductor 374 is generally centrally located on the base 378 and the second conductor 376 extends generally around the first conductor 374 (generally along a perimeter of the base 378). An open slot 380 is defined between the first and second conductors 374 and 376 for partitioning or separating the conductors 374 and 376. The open slot 380 is preferably configured to help provide impedance matching to the cell phone antenna 372 (which may help improve power transfer for the cell phone antenna 372). The base 378 of the cell phone antenna 372 can be constructed from any suitable material within the scope of the present disclosure including, for example, printed circuit board materials, double sided printed circuit board materials, etc. And, the first and second conductors 374 and 376 can be made from any suitable electrically conductive material within the scope of the present disclosure including, for example, metallic materials such as copper, etc., or other electrically conductive materials, etc.

The cell phone antenna 372 may be operable at one or more desired frequencies including, for example frequencies associated with the Global System for Mobile Communications (GSM) 850, the GSM 900, the GSM 1800, the GSM 1900, the Personal Communications Service (PCS), the Universal Mobile Telecommunications System (UMTS), the Advanced Mobile Phone System (AMPS), etc. AMPS typically operates in the 800 MHz frequency band; GSM typically operates in the 900 MHz and 1800 MHz frequency bands in Europe, but in the 850 MHz and 1900 MHz frequency bands in the United States; PCS typically operates in the 1900 MHz frequency band; and UMTS typically operates in the 1900 MHz to 1980 MHz frequency band for uplinks and in the 2110 MHz to 2170 MHz frequency band for downlinks.

As an example, the first conductor 374 may be tuned to receive frequencies over a bandwidth ranging from about 1,650 MHz to about 2,700 MHz, including those frequencies associated with the PCS. And, the second conductor 376 may be tuned to receive frequencies over a bandwidth ranging from about 800 MHz to about 1,000 MHz, including those frequencies associated with the AMPS. Thus, the illustrated cell phone antenna 372 can be viewed as a dual band cell phone antenna 372, operable over multiple bands of frequencies. Multiple cell phones may thus be used in connection with the cell phone antenna 372. The cell phone antenna 372 can be tuned as desired for operation at desired frequency bands by, for example, adjusting configurations (e.g., dimensions, shapes, materials, etc.) of the conductors 374 and 376, etc.

An electrical connector (not shown) may be attached to the first PCB 338 and the second PCB 356 for coupling the antenna assembly 300 to a suitable communication link (e.g., a coaxial cable, etc.) in a mobile platform. In this way, the first and/or second PCB 338 and/or 356 may receive signal inputs from the antennas 320, 322, 370, and/or 372, process the signal inputs, and transmit the processed signal inputs to the suitable communication link. Alternatively, or in addition, the first and/or second PCB 338 and/or 356 may process signal inputs to be transmitted via or through the antennas 320, 322, 370, and/or 372. With this said, it is understood that that the antennas 320, 322, 370, and/or 372 may receive and/or transmit radio signals as desired.

In addition, a cover (not shown) may be provided to help protect the components (e.g., the antennas 320, 322, 370, and 372, the PCBs 338 and 356, etc.) of the antenna assembly 300 when enclosed within the cover. For example, the cover can be configured to couple to the chassis 318 and substantially seal the components of the antenna assembly 300 within the cover, thereby protecting the components against ingress of contaminants (e.g., dust, moisture, etc.) into an interior enclosure of the cover. This also allows the antennas 320, 322, 370, and 372 of the antenna assembly 300 to be co-located under the cover (and together coupled to a mobile platform as desired).

In some example embodiments, the second antenna 322 and/or the third antenna 370 could be configured to receive and/or transmit frequencies associated with Wi-Fi and/or Wi-Max (e.g., frequencies in the 2400 MHz band), frequencies associated with DAB-VHF-III (e.g., frequencies between about 170 MHz and about 230 MHz, etc.) and/or frequencies associated with DAB-L (e.g., frequencies between about 1,452 MHz and about 1,492 MHz, etc.) (see, e.g., U.S. Pat. No. 7,489,280, the entire disclosure of which is incorporated herein by reference, etc.).

In some example embodiments, antenna assemblies of the present disclosure can include antennas (alone or in combination with one or more antennas (e.g., with one or more antennas disclosed herein, etc.)) configured to receive and/or transmit desired and/or suitable frequencies. For example, antenna assemblies can include antennas configured to receive and/or transmit frequencies associated with WiFi and/or Wi-Max (e.g., frequencies in the 2400 MHz band). In these embodiments, diplexer circuits may be used to separate cell phone signals from Wi-Fi and/or Wi-max signals, both when receiving and transmitting. In some example embodiments, antenna assemblies of the present disclosure can include antennas (alone or in combination with one or more antennas (e.g., with one or more antennas disclosed herein, etc.)) configured to receive and/or transmit frequencies associated with DAB-VHF-III (e.g., frequencies between about 170 MHz and about 230 MHz, etc.) and/or frequencies associated with DAB-L (e.g., frequencies between about 1,452 MHz and about 1,492 MHz, etc.).

Antenna assemblies of the present disclosure have generally smaller sizes (e.g., shorter heights due to no masts, etc.) than other antenna assemblies known in the art. In addition, antenna assemblies of the present disclosure allow for packaging of multiple antennas within single structures, which can provide ease of assembly at manufacturing sites as well as decreased costs as compared to requiring use of multiple different antenna assemblies (e.g., with each antenna assembly having a single antenna, etc.).

EXAMPLE

The following example is exemplary in nature. Variations of the following example are possible without departing from the scope of the disclosure.

In this example, the antenna assembly 300 illustrated in FIGS. 10-12 was analyzed for gain and signal strength. The antenna assembly 300 was installed to a roof of a car, with the AM/FM antenna 320 and the cell phone antenna 372 oriented generally vertically and generally perpendicularly to the roof. Here, the roof of the car served as a ground plane for the antenna assembly 300. Gain is an important characteristic of antennas as it represents the ability of antennas to receive from and/or transmit signals to far away distances. And, gain can be measured at various different angles to indicate this ability at those angles. Generally, antennas with larger gains are desirable.

FIGS. 13-20 illustrate various gain measurements (measured in decibels isotropic (dBi)) for the different antennas of the antenna assembly 300 when the antenna assembly 300 is coupled to the roof of a car. The illustrated gain numbers generally show that the antenna assembly 300 was capable of achieving similar gains to larger sized antenna assemblies generally known in the art.

Figure 13:
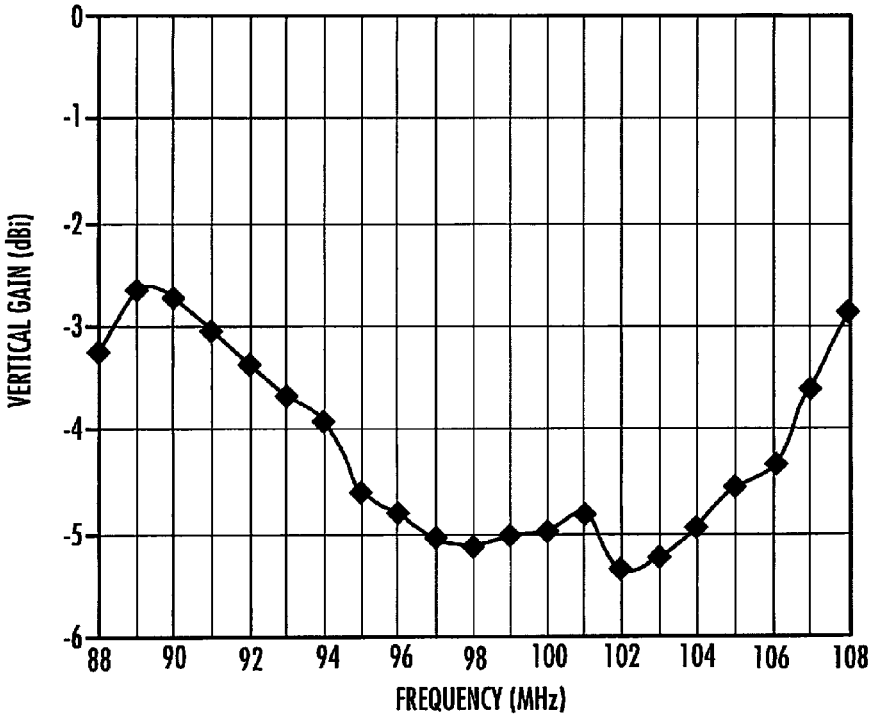
FIG. 13 is a line graph illustrating vertical gain at frequencies ranging between about 88 Megahertz (MHz) and about 108 MHz for an antenna of the antenna assembly of FIG. 10 configured for use with AM/FM radio.

FIG. 13 is a line graph (with corresponding data shown in Table 1) illustrating vertical gain for the AM/FM antenna 320 for frequencies ranging from about 88 MHz to about 108 MHz.

TABLE 1

Example Vertical Gain for AM/FM Antenna

| Frequency (MHz) | Vertical Gain (dBi) |
|---|---|
| 88 | −3.24 |
| 89 | −2.65 |
| 90 | −2.72 |
| 91 | −3.05 |
| 92 | −3.37 |
| 93 | −3.66 |
| 94 | −3.92 |
| 95 | −4.60 |
| 96 | −4.82 |
| 97 | −5.06 |
| 98 | −5.12 |
| 99 | −5.03 |
| 100 | −4.99 |
| 101 | −4.80 |
| 102 | −5.35 |
| 103 | −5.22 |
| 104 | −4.94 |
| 105 | −4.56 |
| 106 | −4.35 |
| 107 | −3.62 |
| 108 | −2.88 |

Figure 14:
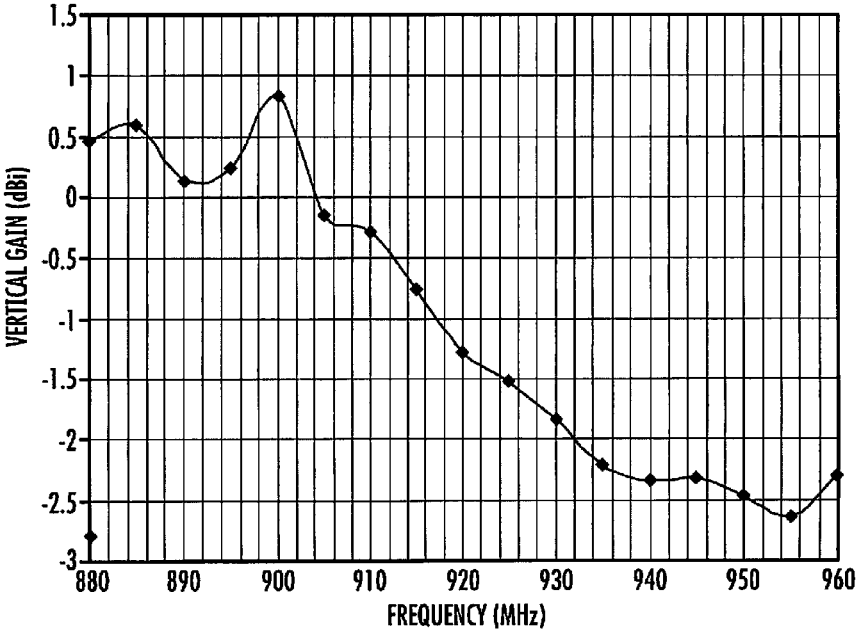
FIGS. 14-18 are line graphs illustrating vertical gain for the cell phone antenna of the antenna assembly of FIG. 10 for select frequencies of the Advanced Mobile Phone System, Global System for Mobile Communications (GSM) 900, GSM 1800, Personal Communications Service, and Universal Mobile Telecommunications System.
Figure 15:
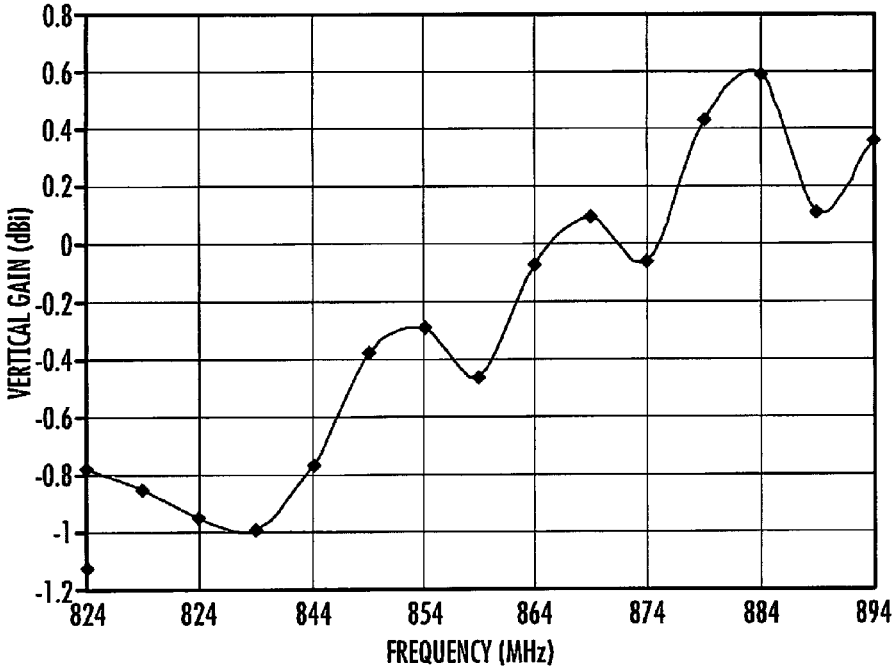
Figure 16:
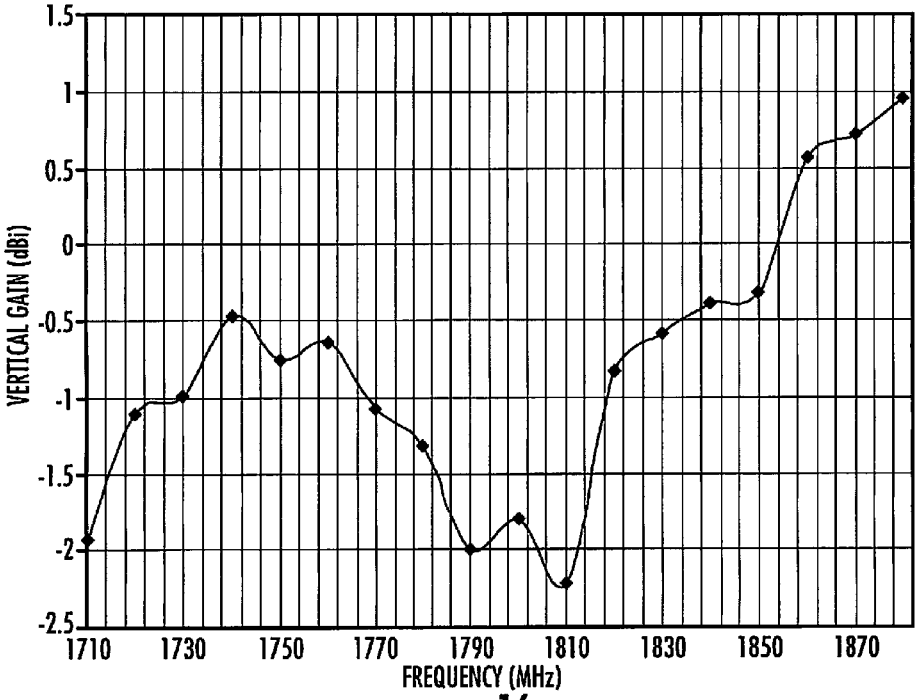
Figure 17:
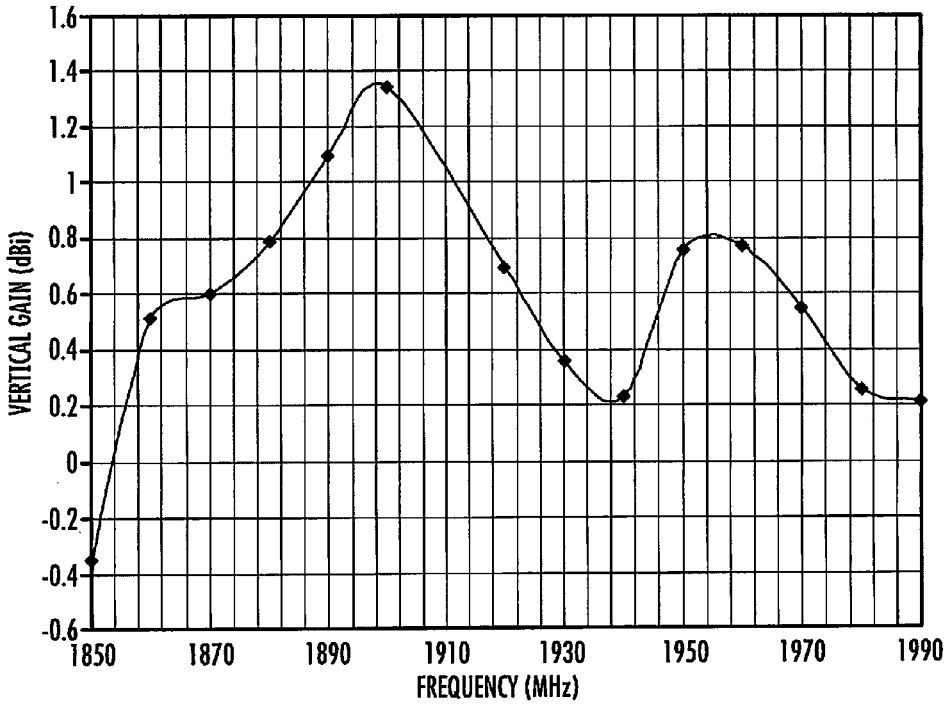
Figure 18:
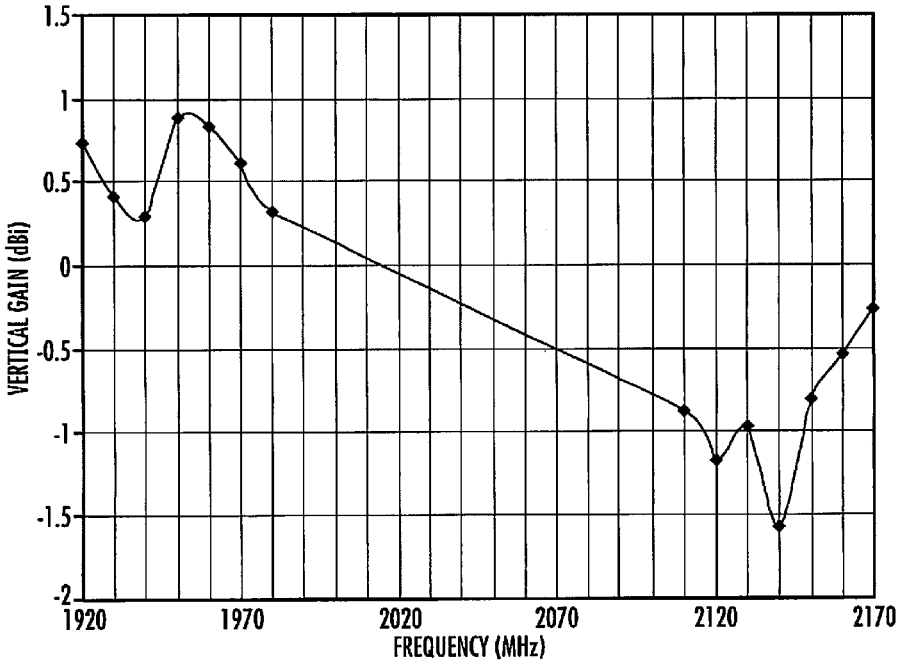

FIG. 14 is a line graph (with corresponding data shown in Table 2) illustrating vertical gain for the cell phone antenna 372 for select frequencies of the AMPS (e.g., frequencies ranging from about 824 MHz to about 894 MHz, etc.). FIG. 15 is a line graph (with corresponding data shown in Table 3) illustrating vertical gain for the cell phone antenna 372 for select frequencies of the GSM 900 (e.g., frequencies ranging from about 880 MHz to about 960 MHz, etc.). FIG. 16 is a line graph (with corresponding data shown in Table 4) illustrating vertical gain for the cell phone antenna 372 for select frequencies of the GSM 1800 (e.g., frequencies ranging from about 1710 MHz to about 1880 MHz, etc.). FIG. 17 is a line graph (with corresponding data shown in Table 5) illustrating vertical gain for the cell phone antenna 372 for select frequencies of the PCS (e.g., frequencies ranging from about 1850 MHz to about 1990 MHz, etc.). And, FIG. 18 is a line graph (with corresponding data shown in Table 6) illustrating vertical gain for the cell phone antenna 372 for select frequencies of the UMTS (e.g., frequencies ranging from about 1920 MHz to about 2170 MHz, etc.).

TABLE 2

Example Vertical Gain for Cell Phone Antenna for Frequencies Associated with AMPS

| Frequency (MHz) | Vertical Gain (dBi) |
|---|---|
| 824 | −0.78 |
| 829 | −0.85 |
| 834 | −0.95 |
| 839 | −0.99 |
| 844 | −0.77 |
| 849 | −0.38 |
| 854 | −0.29 |
| 859 | −0.46 |
| 864 | −0.07 |
| 869 | 0.09 |
| 874 | −0.06 |
| 879 | 0.43 |
| 884 | 0.59 |
| 889 | 0.11 |
| 894 | 0.36 |

TABLE 3

Example Vertical Gain for Cell Phone Antenna for Frequencies Associated with GSM 900

| Frequency (MHz) | Vertical Gain (dBi) |
|---|---|
| 880 | 0.46 |
| 885 | 0.59 |
| 890 | 0.14 |
| 895 | 0.23 |
| 900 | 0.83 |
| 905 | −0.15 |
| 910 | −0.28 |
| 915 | −0.76 |
| 920 | −1.28 |
| 925 | −1.52 |
| 930 | −1.83 |
| 935 | −2.22 |
| 940 | −2.34 |
| 945 | −2.32 |
| 950 | −2.47 |
| 955 | −2.64 |
| 960 | −2.3 |

TABLE 4

Example Vertical Gain for Cell Phone Antenna for Frequencies Associated with GSM 1800

| Frequency (MHz) | Vertical Gain (dBi) |
|---|---|
| 1710 | −1.93 |
| 1720 | −1.1 |
| 1730 | −0.99 |
| 1740 | −0.47 |
| 1750 | −0.76 |
| 1760 | −0.64 |
| 1770 | −1.07 |
| 1780 | −1.32 |
| 1790 | −2 |
| 1800 | −1.8 |

TABLE 4-continued

Example Vertical Gain for Cell Phone Antenna for Frequencies Associated with GSM 1800

| Frequency (MHz) | Vertical Gain (dBi) |
|---|---|
| 1810 | −2.22 |
| 1820 | −0.84 |
| 1830 | −0.59 |
| 1840 | −0.4 |
| 1850 | −0.33 |
| 1860 | 0.57 |
| 1870 | 0.71 |
| 1880 | 0.95 |

TABLE 5

Example Vertical Gain for Cell Phone Antenna for Frequencies Associated with PCS

| Frequency (MHz) | Vertical Gain (dBi) |
|---|---|
| 1850 | −0.35 |
| 1860 | 0.51 |
| 1870 | 0.6 |
| 1880 | 0.79 |
| 1890 | 1.09 |
| 1900 | 1.34 |
| 1920 | 0.7 |
| 1930 | 0.36 |
| 1940 | 0.23 |
| 1950 | 0.76 |
| 1960 | 0.77 |
| 1970 | 0.55 |
| 1980 | 0.26 |
| 1990 | 0.21 |

TABLE 6

Example Vertical Gain for Cell Phone Antenna for Frequencies Associated with UMTS

| Frequency (MHz) | Vertical Gain (dBi) |
|---|---|
| 1920 | 0.74 |
| 1930 | 0.41 |
| 1940 | 0.3 |
| 1950 | 0.891 |
| 1960 | 0.84 |
| 1970 | 0.61 |
| 1980 | 0.32 |
| 2110 | −0.88 |
| 2120 | −1.18 |
| 2130 | −0.98 |
| 2140 | −1.57 |
| 2150 | −0.81 |
| 2160 | −0.54 |
| 2170 | −0.26 |

Figure 19:
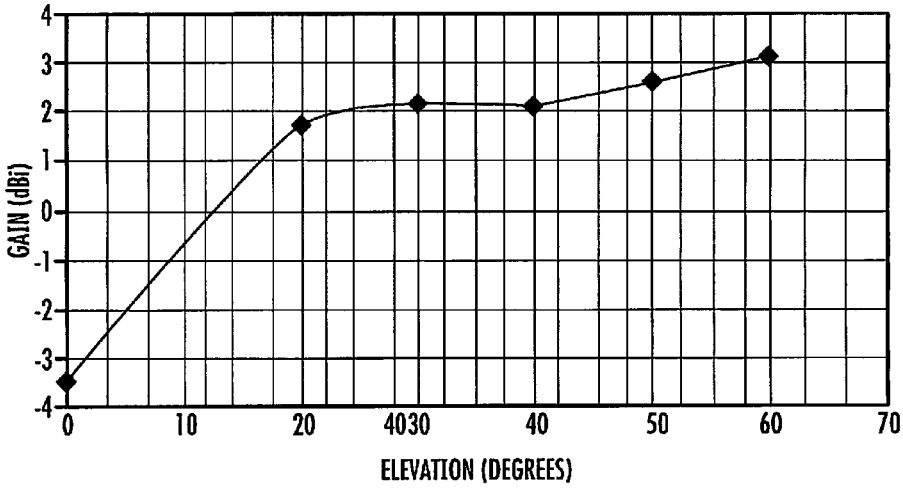
FIG. 19 is a line graph illustrating gain at frequencies ranging between about 2,320 MHz and about 2,345 MHz at various different elevations for an antenna of the antenna assembly of FIG. 10 configured for use with satellite digital audio radio services.
Figure 20:
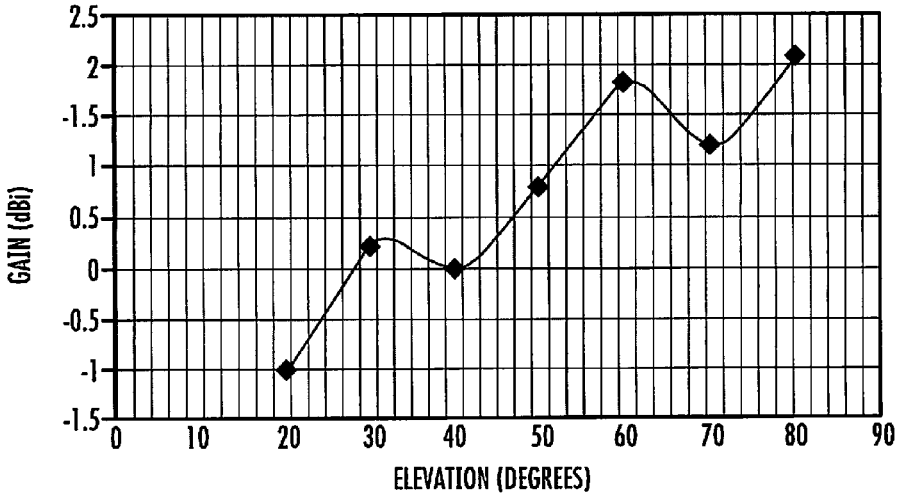
FIG. 20 is a line graph illustrating gain at frequencies ranging between about 1,574 MHz and about 1,576 MHz at various different elevations for an antenna of the antenna assembly of FIG. 10 configured for use with global positioning systems.

FIG. 19 is a line graph (with corresponding data shown in Table 7) illustrating gain for the SDARS antenna 322 for frequencies ranging from about 2,320 MHz and about 2,345 MHz at various different elevations. And, FIG. 20 is a line graph (with corresponding data shown in Table 8) illustrating gain for the GPS antenna 370 for frequencies ranging from about 1,574 MHz and about 1,576 MHz at various different elevations.

TABLE 7

| Example Gain for SDARS Antenna at Different Elevations | |
|---|---|
| Elevation (degrees) | Gain (dBi) |
| 0 | −3.5 |
| 20 | 1.75 |
| 30 | 2.2 |
| 40 | 2.1 |
| 50 | 2.6 |
| 60 | 3.1 |

TABLE 8

| Example Gain for GPS Antenna at Different Elevations | |
|---|---|
| Elevation (degrees) | Gain (dBi) |
| 20 | −1 |
| 30 | 0.2 |
| 40 | 0 |
| 50 | 0.8 |
| 60 | 1.8 |
| 70 | 1.2 |
| 80 | 2.1 |

Figure 21:
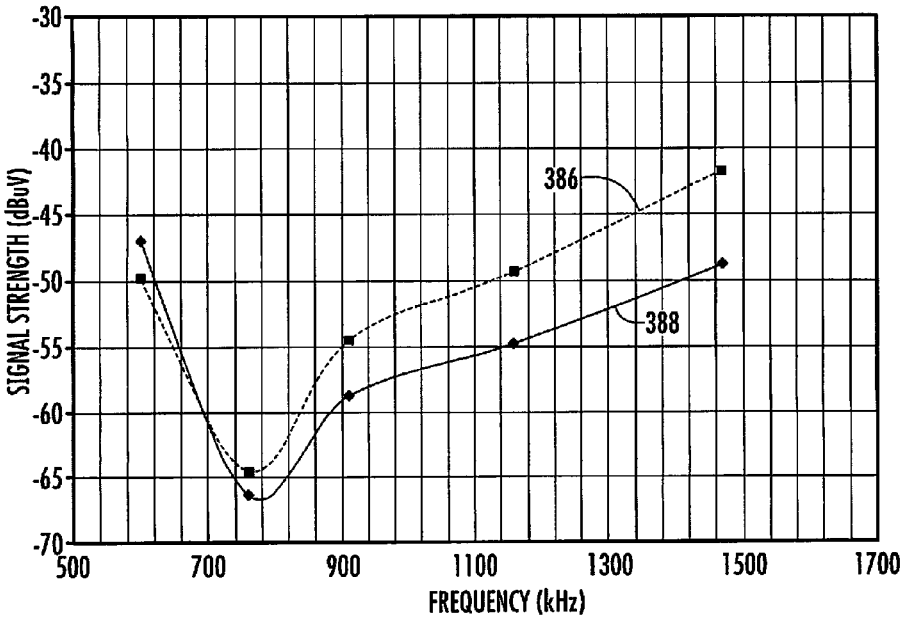
FIG. 21 is a line graph illustrating signal strength comparison between the AM/FM antenna of the antenna assembly of FIG. 10 and a reference antenna mast.

FIG. 21 is a line graph illustrating signal strength comparison between the AM/FM antenna 320 and a reference antenna mast. In this example, the AM/FM antenna 320 had a height of about 54 mm. The reference antenna mast was a solid rod mast having a length of about 80 centimeters, and that was resonant in the middle of the U.S. FM band (at a frequency of about 98 MHz). This reference mast was used as a standard of comparison for the AM/FM antenna 320. Line 386 identifies signal strength for the AM/FM antenna 320, and line 388 identifies signal strength for the reference antenna mast. Corresponding data is provided in Table 8. Signal strength is measured in decibels relative to one microvolt (dBpV). As can be seen, signal strength for the AM/FM antenna 320 was generally higher (or stronger) than signal strength 388 for the reference antenna mast for frequencies between at least about 760 KHz and about 1470 KHz.

TABLE 9

| Signal Strength Comparison Between Reference Antenna and AM/FM Antenna | | |
|---|---|---|
| Frequency (KHz) | Reference Antenna Signal Strength (dBμV)) | AM/FM Antenna Signal Strength (dBμV) |
| 600 | −47 | −49.8 |
| 760 | −66.4 | −64.6 |
| 910 | −58.7 | −54.5 |
| 1160 | −54.8 | −49.3 |
| 1470 | −48.8 | −41.7 |

Figure 22:
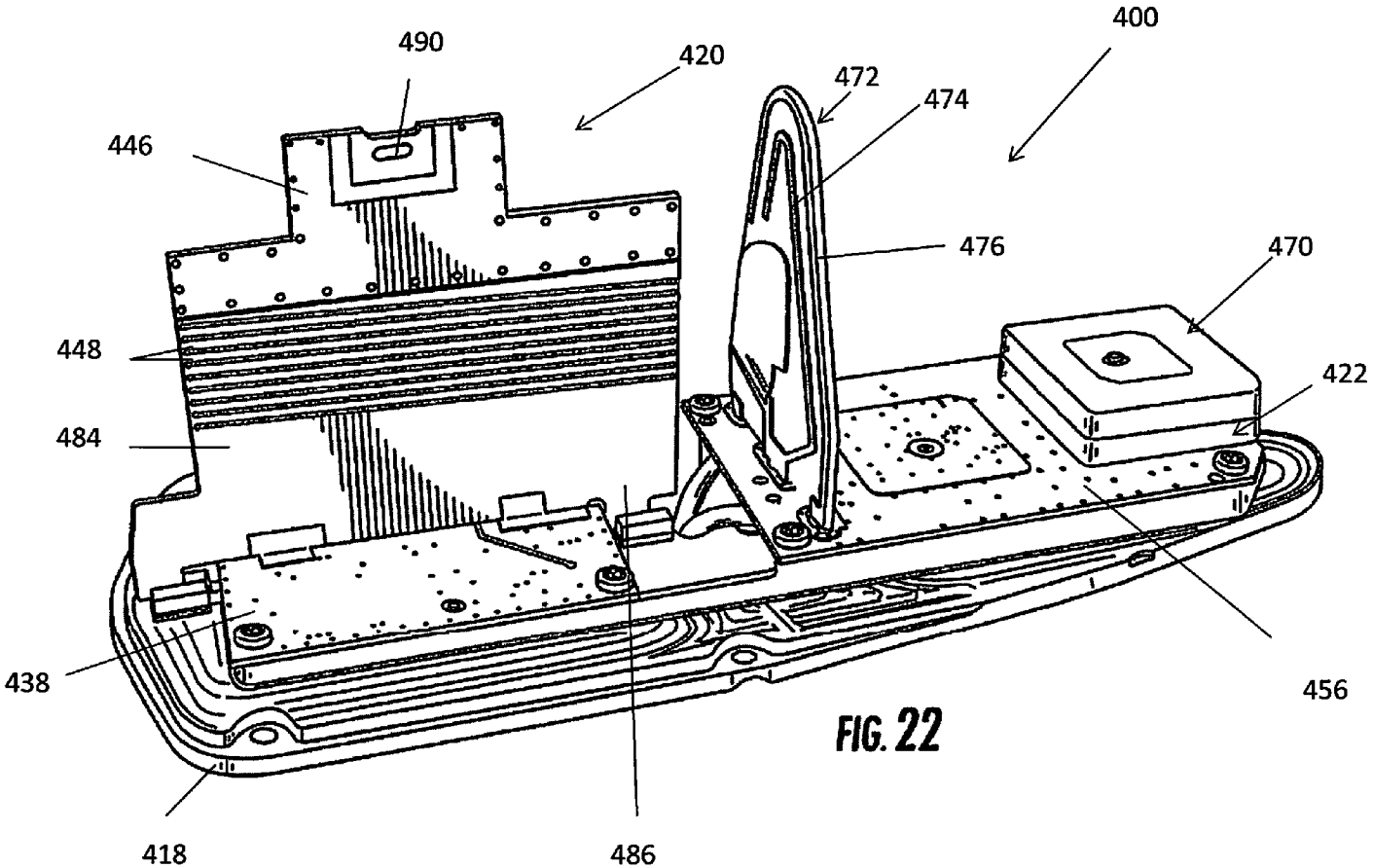
FIG. 22 is a left side perspective view of an example embodiment of an antenna assembly including at least one or more aspects of the present disclosure with a cover of the antenna assembly not shown.

FIG. 22 illustrates another example embodiment of an antenna assembly 400 including at least one or more aspects of the present disclosure. The antenna assembly 400 of this embodiment is similar to the antenna assembly 300 previously described and illustrated in FIGS. 10-12. For example, the antenna assembly 400 of this embodiment includes a chassis 418 configured to couple the antenna assembly 400 to a mobile platform, and first, second, third, and fourth antennas 420, 422, 470, and 472 coupled to the chassis 418 (with each of the first, second, third, and fourth antennas 420, 422, 470, and 472 co-located on or supported by the chassis 418).

The first antenna 420 is a vertical monopole antenna configured for use with AM/FM radio (e.g., configured for receiving desired AM/FM radio signals, etc.). In this exemplary embodiment, the AM/FM antenna 420 includes, is defined by, etc. a PCB 484. The AM/FM antenna PCB 484 is coupled to the chassis 418 at a first PCB 438 located toward a rearward portion of the chassis 418. The first PCB 438 is coupled to the chassis 418 by mechanical fasteners, and the AM/FM antenna PCB 484 is coupled to the first PCB 438 by solder. Other suitable couplings may be used as desired. In addition, tab portions 486 of the AM/FM antenna PCB 484 interconnect with corresponding slot portions of the PCB 438 to further help position and/or couple the AM/FM antenna PCB 484 on the PCB 438.

Also in this exemplary embodiment shown in FIG. 22, electrically conductive plating 446 is provided toward an upper portion of the AM/FM antenna 420 (e.g., toward an upper portion of the AM/FM antenna PCB 484, etc.) for capacitively loading the AM/FM antenna 420. This defines a capacitively loaded portion of the AM/FM antenna 420, toward an upper portion of the AM/FM antenna 420.

In addition, electrically conductive traces 448 (broadly, electrical conductors) are provided along a middle portion of the AM/FM antenna 420 (e.g., toward a middle portion of the AM/FM antenna PCB 484, etc.) for inductively loading the middle portion of the AM/FM antenna 420. This defines an inductively loaded portion of the AM/FM antenna 420, toward a middle portion of the AM/FM antenna 420. The traces 448 may be etched around the PCB 484. The traces 448 are oriented generally parallel to each other along respective side surfaces of the AM/FM antenna PCB 484 and extend lengthwise along the AM/FM antenna PCB 484. End portions of the traces 448 may curve around or extend through the AM/FM antenna PCB 484 (at locations toward side edge portions of the PCB 484) and thereby interconnect corresponding traces 448 on the opposing side surfaces of the AM/FM antenna PCB 484. As such, the traces 448 define a continuous electrical path generally coiling around at least part of the AM/FM antenna 420 (e.g., around the AM/FM antenna PCB 484 in a clockwise direction when viewed from above, etc.). In the illustrated embodiment, the antenna assembly 400 includes nine traces 448 located along the first and second surfaces of the AM/FM antenna PCB 484. Other antenna assemblies may include other numbers of traces (e.g., ten traces, eleven traces, etc.) as desired. In addition, the number of traces on each side of the AM/FM antenna PCB 484 may be different.

The AM/FM antenna 420 may also include a clip (e.g., electrically-conductive spring clip, etc.) coupled to or within an upper portion 490 of the AM/FM antenna PCB 484. The clip is constructed from a suitable electrically conductive material (e.g., metal, etc.) and is configured to engage an inner electrically-conductive portion within a cover (e.g., an insert or top load plate inserted into the cover, etc.) when the cover is positioned over the antenna assembly 400. As such, the clip may operate to establish electrical contact between the AM/FM antenna 420 and the cover. In an exemplary embodiment the clip defines a generally English-language letter C shape. In other example embodiments, antenna assemblies can have clips with other suitable shapes.

A coupling wire may be used to electrically connect the AM/FM antenna 420 to the first PCB 438. The coupling wire may connect through the PCB 438 (e.g., via a solder connection, etc.) to a lower trace on the PCB 484. This electrically connects the PCB 438 to the traces 448 (and the AM/FM antenna 420), thereby helping define the inductively loaded portion of the AM/FM antenna 420. An upper trace on the PCB 484 may connect (e.g., via a solder connection, etc.) to the plating 446. This electrically connects the first PCB 438 to the plating 446 (via the traces 448), thereby helping define the capacitively loaded portion of the AM/FM antenna 420.

The AM/FM antenna 420 may be operable at one or more frequencies including, for example frequencies ranging between about 140 KHz and about 110 MHz, etc. For example, the illustrated AM/FM antenna 420 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM antenna 420 may also be tuned as desired for operation at desired frequency bands by, for example, adjusting dimensions of the plating 446 provided toward the upper portion of the AM/FM antenna 420, adjusting size and/or number and/or orientation and/or type of the traces 448 provided around the PCB 484, etc. For example, the AM/FM antenna 420 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

The second antenna 422 of the illustrated antenna assembly 400 is a patch antenna configured for use with SDARS (e.g., configured for receiving desired SDARS signals, etc.). This SDARS antenna 422 is coupled to the chassis 418 at a second PCB 456 located toward a forward portion of the chassis 418. The second PCB 456 is fastened to the chassis 418 by mechanical fasteners. The SDARS antenna 422 is electrically coupled to the second PCB 456 as desired and fastened thereto by a mechanical fastener. The SDARS antenna 422 may be operable at one or more desired frequencies including, for example, frequencies ranging between about 2,320 MHz and about 2,345 MHz, etc. The SDARS antenna 422 may also be tuned as desired for operation at desired frequency bands by, for example, changing dielectric materials, changing sizes of metal plating, etc. used in connection with the SDARS antenna 422, etc.

The third antenna 470 is a patch antenna configured for use with global positioning systems (GPS) (e.g., configured for receiving desired GPS signals, etc.). This GPS antenna 470 may be coupled to the chassis 418 via the second PCB 456 at a location adjacent the SDARS antenna 422. In the illustrated embodiment, the GPS antenna 470 is shown stacked with the SDARS antenna 422 (one on top of the other) on the second PCB 456. As such, the SDARS antenna 422 and the GPS antenna 470 are co-located on or supported by the second PCB 456. The GPS antenna 470 may be operable at one or more desired frequencies including, for example, frequencies ranging between about 1,574 MHz and about 1,576 MHz, etc. And, the GPS antenna 470 may also be tuned as desired for operation at desired frequency bands by, for example, changing dielectric materials, changing sizes of metal plating, etc. used in connection with the GPS antenna 470, etc.

The fourth antenna 472 is a vertical monopole antenna configured for use with cell phones (e.g., for receiving desired cell phone signals, etc.). This cell phone antenna 472 is coupled to the chassis 418 at the second PCB 456 at a location adjacent the SDARS antenna 422 and GPS antenna 470 (e.g., in a similar fashion to how the cell phone antenna 372 is coupled to the chassis 318 for the antenna assembly 300 illustrated in FIGS. 10-12, etc.). As such, the SDARS antenna 422, the GPS antenna 470, and the cell phone antenna 472 are co-located on or supported by the second PCB 456.

The cell phone antenna 472 includes first and second conductors 474 and 476 (or radiating elements) positioned along base 478, which is generally vertically oriented relative to the second PCB 456. The first and second conductors 474 and 476 are soldered to the second PCB 456, as is suitable, for electrically connecting the cell phone antenna 472 to the second PCB 456. The first and second conductors 474 and 476 are oriented such that the first conductor 474 is generally centrally located on the base 478 and the second conductor 476 extends generally around the first conductor 474. The first and second conductors 474 and 476 are spaced apart such that an open slot is defined between the first and second conductors 474 and 476 for partitioning or separating the conductors 474 and 476. The open slot is preferably configured to help provide impedance matching to the cell phone antenna 472 (which may help improve power transfer for the cell phone antenna 472). The base 478 of the cell phone antenna 472 can be constructed from any suitable material within the scope of the present disclosure including, for example, printed circuit board materials, double sided printed circuit board materials, other substrate materials, etc. And, the first and second conductors 474 and 476 can be made from any suitable electrically conductive material within the scope of the present disclosure including, for example, metallic materials such as copper, etc., or other electrically conductive materials, etc.

The cell phone antenna 472 may be operable at one or more desired frequencies including, for example frequencies associated with the Global System for Mobile Communications (GSM) 850, the GSM 900, the GSM 1800, the GSM 1900, the Personal Communications Service (PCS), the Universal Mobile Telecommunications System (UMTS), the Advanced Mobile Phone System (AMPS), etc. AMPS typically operates in the 800 MHz frequency band; GSM typically operates in the 900 MHz and 1800 MHz frequency bands in Europe, but in the 850 MHz and 1900 MHz frequency bands in the United States; PCS typically operates in the 1900 MHz frequency band; and UMTS typically operates in the 1900 MHz to 1980 MHz frequency band for uplinks and in the 2110 MHz to 2170 MHz frequency band for downlinks.

As an example, the first conductor 474 may be tuned to receive frequencies over a bandwidth ranging from about 1,650 MHz to about 2,700 MHz, including those frequencies associated with the PCS. And, the second conductor 476 may be tuned to receive frequencies over a bandwidth ranging from about 800 MHz to about 1,000 MHz, including those frequencies associated with the AMPS. Thus, the illustrated cell phone antenna 472 can be viewed as a dual band cell phone antenna 472, operable over multiple bands of frequencies. Multiple cell phones may thus be used in connection with the cell phone antenna 472. The cell phone antenna 472 can be tuned as desired for operation at desired frequency bands by, for example, adjusting configurations (e.g., dimensions, shapes, materials, etc.) of the conductors 474 and 476, etc.

An electrical connector (not shown) may be attached to the first PCB 438 and the second PCB 456 for coupling the antenna assembly 400 to a suitable communication link (e.g., a coaxial cable, etc.) in a mobile platform. In this way, the first and/or second PCB 438 and/or 456 may receive signal inputs from the antennas 420, 422, 470, and/or 472, process the signal inputs, and transmit the processed signal inputs to the suitable communication link. Alternatively, or in addition, the first and/or second PCB 438 and/or 456 may process signal inputs to be transmitted via or through the antennas 420, 422, 470, and/or 472. With this said, it is understood that that the antennas 420, 422, 470, and/or 472 may receive and/or transmit radio signals as desired.

In some example embodiments, the second antenna 422 and/or the third antenna 470 could be configured to receive and/or transmit frequencies associated with Wi-Fi and/or Wi-Max (e.g., frequencies in the 2400 MHz band), frequencies associated with DAB-VHF-III (e.g., frequencies between about 170 MHz and about 230 MHz, etc.) and/or frequencies associated with DAB-L (e.g., frequencies between about 1,452 MHz and about 1,492 MHz, etc.) (see, e.g., U.S. Pat. No. 7,489,280, the entire disclosure of which is incorporated herein by reference, etc.).

Figure 23:
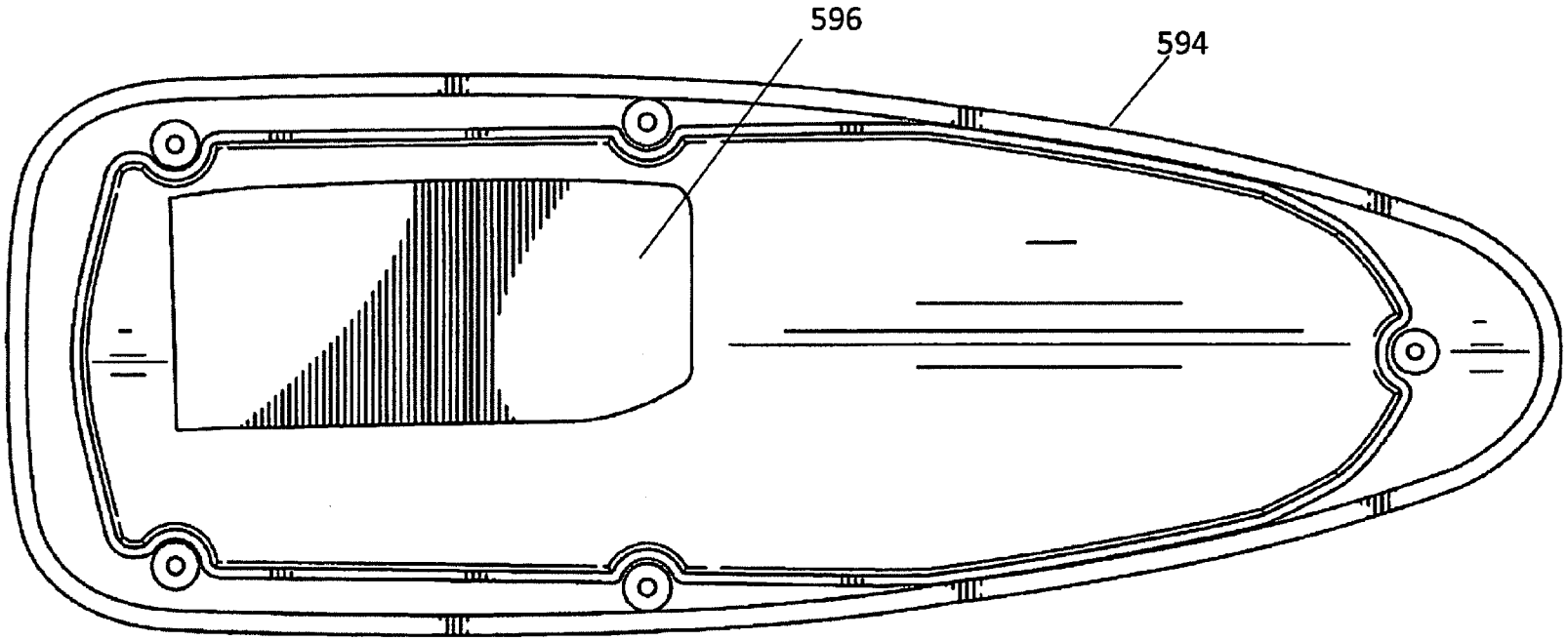
FIG. 23 is a bottom view of a cover suitable for use with antenna assemblies of the present disclosure, and illustrating an interior of the cover and an insert (e.g., a top-load plate, etc.) within the cover for forming a capacitive load portion of an antenna according to exemplary embodiments.

FIG. 23 illustrates an example cover, housing, or radome 594 suitable for use with the antenna assembly 400 illustrated in FIG. 22 (or, for that matter, with other antenna assemblies of the present disclosure). The cover 594 can help protect the components (e.g., the antennas 420, 422, 470, and 472, the PCBs 438 and/or 456 and/or 484, etc.) of the antenna assembly 400 when enclosed within the cover 594. For example, the cover 594 can be configured to couple to the chassis 418 and substantially seal the components of the antenna assembly 400 within the cover 594, thereby protecting the components against ingress of contaminants (e.g., dust, moisture, etc.) into an interior enclosure of the cover 594. This also allows the antennas 420, 422, 470, and 472 of the antenna assembly 400 to be co-located under the cover 594 (and together coupled to a mobile platform as desired).

The illustrated cover 594 includes an insert 596 (e.g., a top-load metal plate, etc.) that is positioned within a top inner portion of the cover 594. For example, if the cover 594 is installed to the antenna assembly 400, the insert 596 is capable of electrically contacting the clip of the AM/FM antenna 420 when the cover 594 is positioned over the antenna assembly 400. The insert 596 is constructed from a suitable electrically conductive material (e.g., metal, etc.). As such, the clip and insert 596 can operate to establish electrical contact between the AM/FM antenna 420 and the insert 596, whereby the insert 596 operates to form a capacitive load portion of the AM/FM antenna 420.

Figure 24:
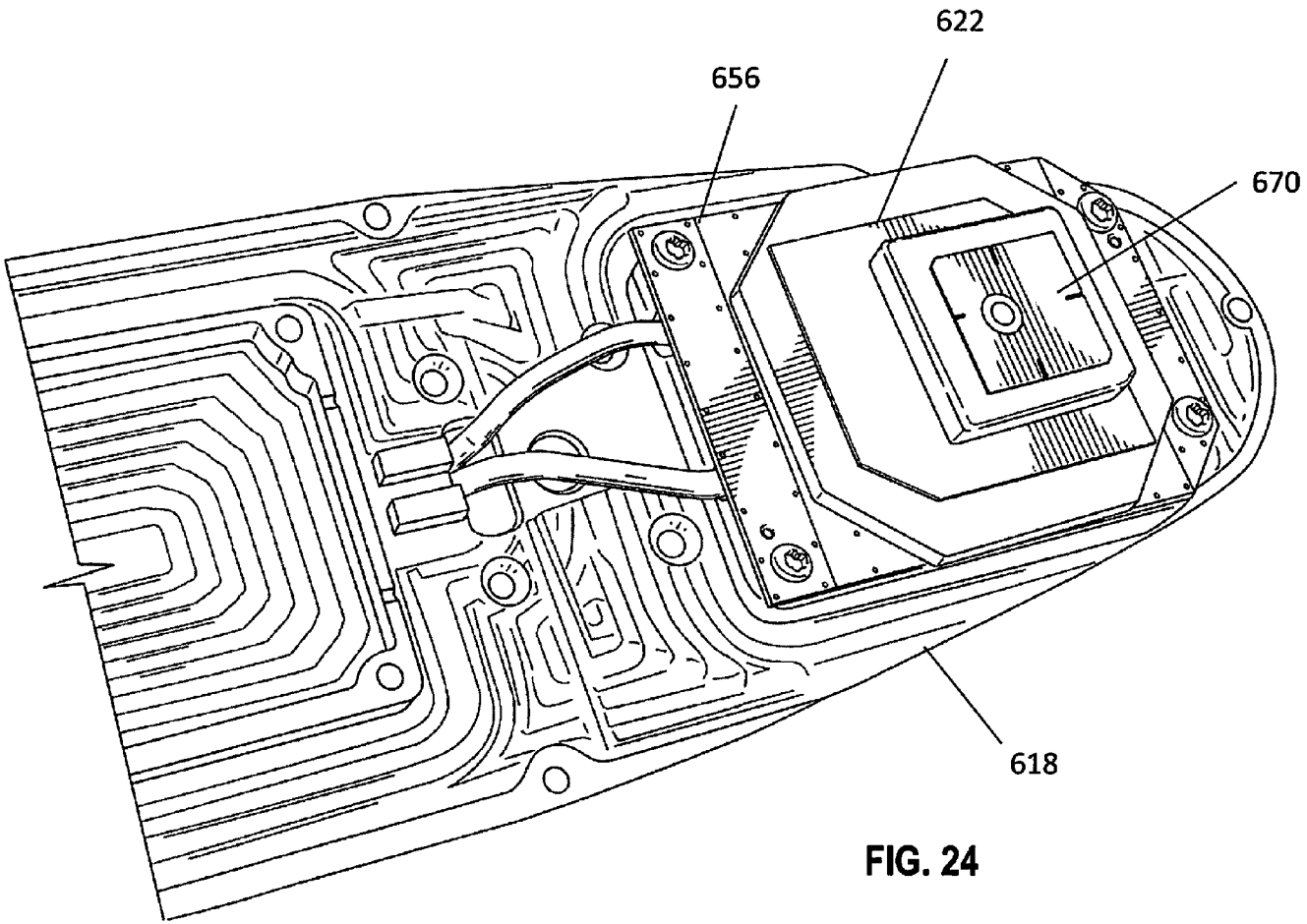
FIG. 24 is a fragmentary perspective view of an example stacked orientation of an SDARS antenna and a GPS antenna.

FIG. 24 illustrates an example stacked orientation of an SDARS antenna 622 and a GPS antenna 670 (one on top of the other). The stacked antennas 622 and 670 are shown coupled to a PCB 656 (e.g., via suitable operations such as, for example, any of those described herein, etc.). And, the PCB 656 is shown coupled to a chassis 618 (e.g., via suitable operations such as, for example, any of those described herein, etc.). The illustrated stacked SDARS and GPS antennas 622 and 670 can be included with any of the embodiments of antenna assemblies of the present disclosure (e.g., antenna assembly 100, 200, 300, 400, 700, 800, 900, 1000, 1100, etc.) as desired.

Figure 25:
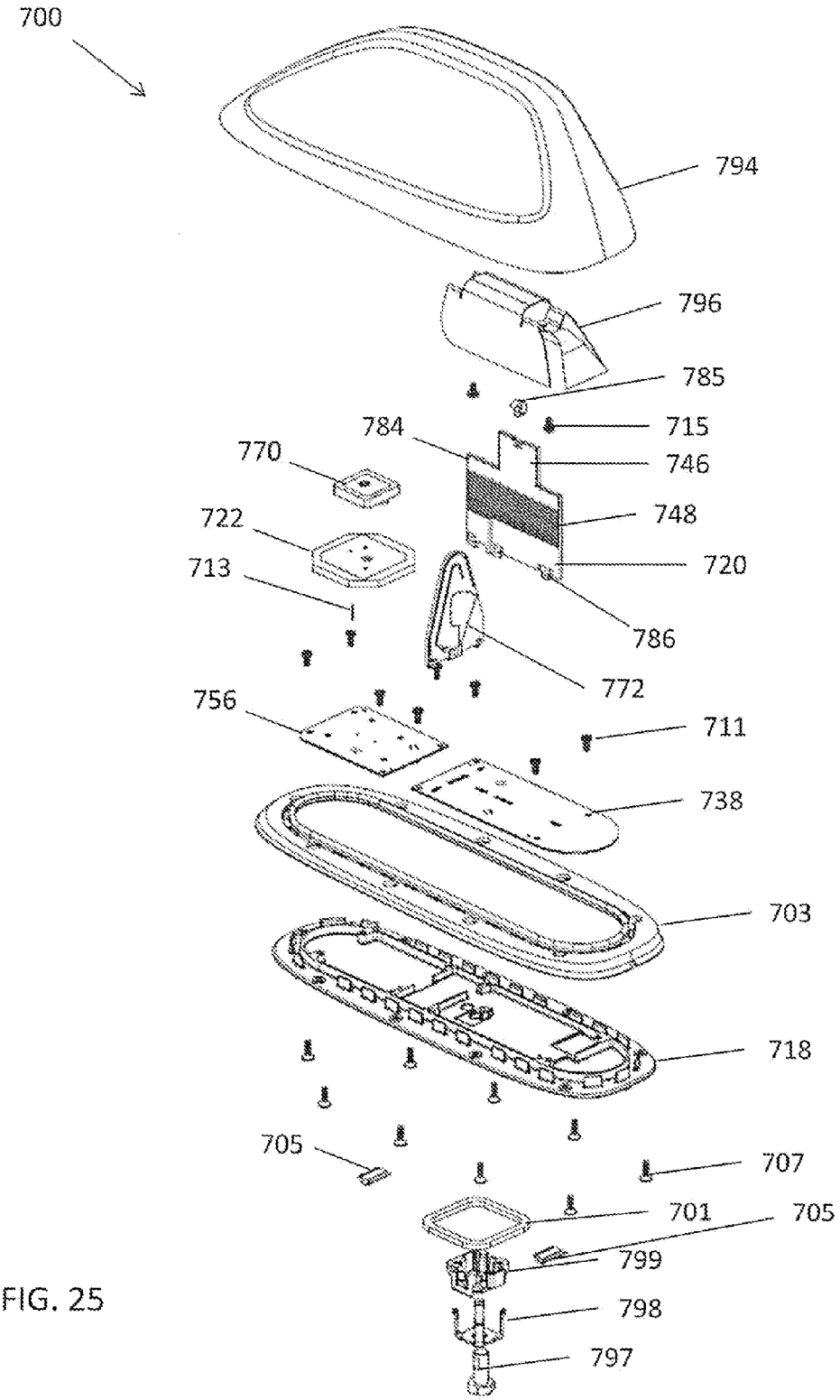
FIG. 25 is an exploded perspective view of an example embodiment of an antenna assembly including at least one or more aspects of the present disclosure.
Figure 26:
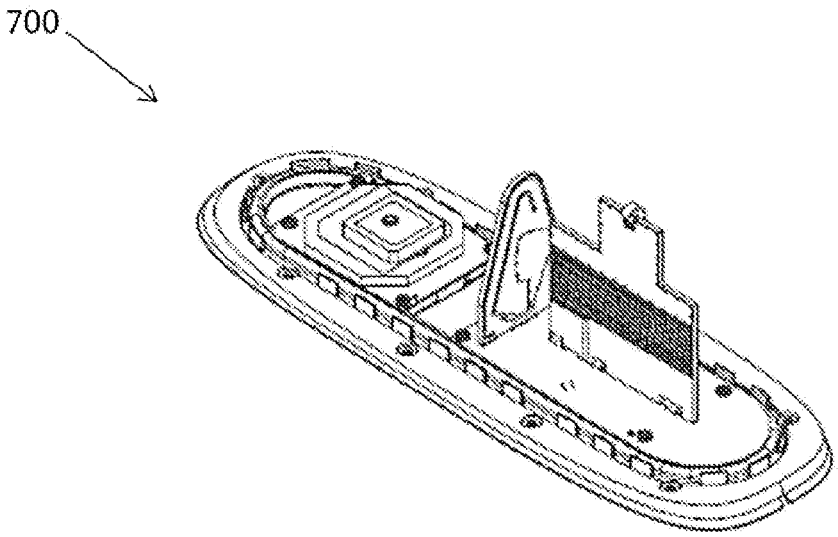
FIG. 26 is a perspective view of the antenna assembly shown in FIG. 25 after being assembled together.
Figure 27:
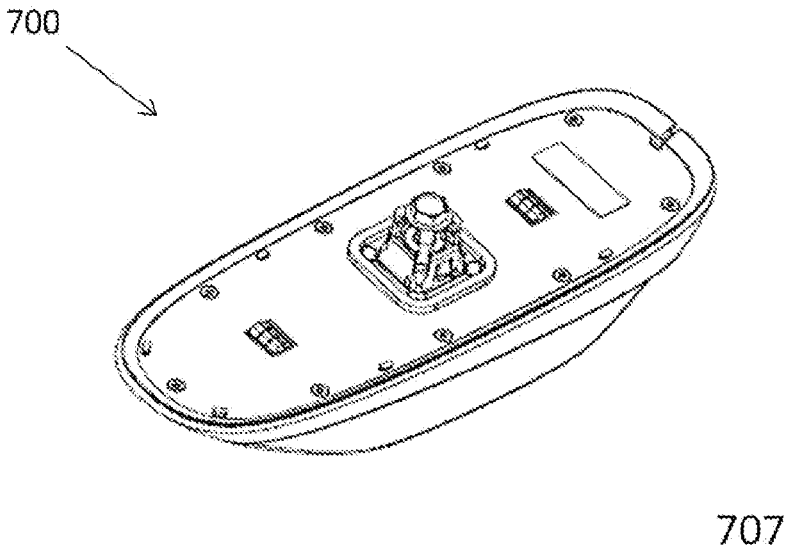
FIG. 27 is a lower perspective view of the antenna assembly shown in FIG. 26.
Figure 28:
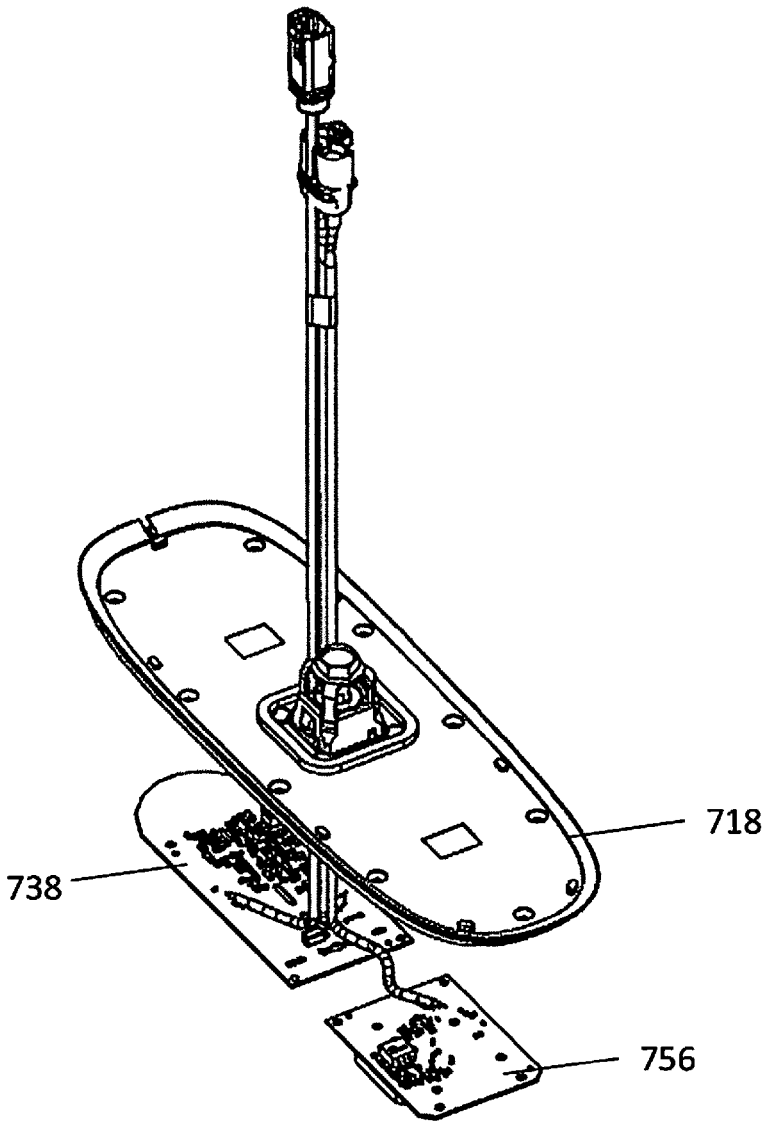
FIG. 28 is a lower perspective view showing an exemplary communication links and electrically connectors for coupling the antenna assembly shown in FIG. 25 to electronic devices within a car.
Figure 29:
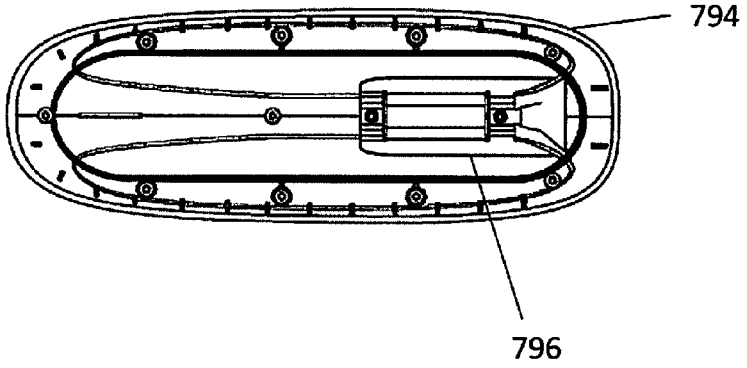
FIG. 29 is a bottom view showing the electrically-conductive insert mechanically fastened within the radome of the antenna assembly shown in FIG. 25.

FIG. 25 illustrates another example embodiment of an antenna assembly 700 including at least one or more aspects of the present disclosure. The antenna assembly 700 of this embodiment may include features similar to the antenna assembly 400 shown in FIG. 22 and/or features similar to the radome 594 and insert 596 shown in FIG. 23.

For example, the antenna assembly 700 of this embodiment includes a chassis 718 configured to couple the antenna assembly 700 to a mobile platform. The antenna assembly 700 also includes first, second, third, and fourth antennas 720, 722, 770, and 772. In this example, the antennas 720, 722, 770 and 772 are configured respectively for AM/FM radio, SDARS, GPS, and cellular.

The first antenna 720 is a vertical monopole antenna configured for use with AM/FM radio (e.g., configured for receiving desired AM/FM radio signals, etc.). In this exemplary embodiment, the AM/FM antenna 720 includes, is defined by, etc. a PCB 784. The AM/FM antenna PCB 784 is coupled to the chassis 718 at a first PCB 738 located toward a rearward portion of the chassis 718. The first PCB 738 is coupled to the chassis 718 by mechanical fasteners 711, and the AM/FM antenna PCB 784 is coupled to the first PCB 738 by solder. Other suitable couplings may be used as desired. In addition, tab portions 786 of the AM/FM antenna PCB 784 interconnect with corresponding slot portions of the PCB 738 to further help position and/or couple the AM/FM antenna PCB 784 on the PCB 738.

Also in this exemplary embodiment shown in FIG. 25, electrically conductive plating 746 is provided toward an upper portion of the AM/FM antenna 720 (e.g., toward an upper portion of the AM/FM antenna PCB 784, etc.) for capacitively loading the AM/FM antenna 720. This defines a capacitively loaded portion of the AM/FM antenna 720, toward an upper portion of the AM/FM antenna 720.

In addition, electrically conductive traces 748 (broadly, electrical conductors) are provided along a middle portion of the AM/FM antenna 720 (e.g., toward a middle portion of the AM/FM antenna PCB 784, etc.) for inductively loading the middle portion of the AM/FM antenna 720. This defines an inductively loaded portion of the AM/FM antenna 720, toward a middle portion of the AM/FM antenna 720. The traces 748 may be etched around the PCB 784. The traces 748 are oriented generally parallel to each other along respective side surfaces of the AM/FM antenna PCB 784 and extend lengthwise along the AM/FM antenna PCB 784. End portions of the traces 748 may curve around or extend through the AM/FM antenna PCB 784 (at locations toward side edge portions of the PCB 784) and thereby interconnect corresponding traces 748 on the opposing side surfaces of the AM/FM antenna PCB 784. As such, the traces 748 define a continuous electrical path generally coiling around at least part of the AM/FM antenna 720 (e.g., around the AM/FM antenna PCB 784 in a clockwise direction when viewed from above, etc.). In this illustrated embodiment, the antenna assembly 700 includes eleven traces 748 located along the AM/FM antenna PCB 784. Other antenna assemblies may include other numbers of traces (e.g., nine traces, eleven traces, etc.) as desired. In addition, the number of traces on each side of the AM/FM antenna PCB 784 may be different.

A clip 785 (e.g., electrically-conductive spring clip, etc.) is coupled to (e.g., soldered, etc.) an upper portion of the AM/FM antenna PCB 784. The clip is constructed from a suitable electrically conductive material (e.g., metal, etc.) and is configured to electrically connect to an insert 796 (e.g., a top load plate inserted into the cover, etc.) that is positioned and mechanically fastened (e.g., by mechanical fasteners 715, etc.) within the radome 794. As such, the clip 785 and insert 796 can operate to establish electrical contact between the AM/FM antenna 720 and the insert 796, whereby the insert 796 operates to form a capacitive load portion of the AM/FM antenna 720.

The second antenna 722 is a patch antenna configured for use with SDARS (e.g., configured for receiving desired SDARS signals, etc.). This SDARS antenna 722 is coupled to the chassis 718 at a second PCB 756 located toward a forward portion of the chassis 718. The second PCB 756 is fastened to the chassis 718 by mechanical fasteners 711. The SDARS antenna 722 is electrically coupled to the second PCB 756 as desired (e.g., by a patch pin 713, etc.) and fastened thereto, e.g., by a mechanical fastener.

The third antenna 770 is a patch antenna configured for use with global positioning systems (GPS) (e.g., configured for receiving desired GPS signals, etc.). In the illustrated embodiment, the GPS antenna 770 is stacked with the SDARS antenna 722 (one on top of the other) on the second PCB 756.

The fourth antenna 772 is a vertical monopole antenna configured for use with cell phones (e.g., for receiving desired cell phone signals, etc.). This cell phone antenna 772 is coupled to the chassis 718 at the first PCB 738 at a location adjacent the AM/FM antenna 720.

The antenna assembly 700 also includes a fastener member 797 (e.g., threaded mounting bolt having a hexagonal head, etc.), a first retention component 798 (e.g., an insulator clip, etc.), and a second retention component 799 (e.g., retaining clip, etc.). The fastener member 797 and retention members 798, 799 may be used to mount the antenna assembly to an automobile roof, hood, trunk (e.g., with an unobstructed view overhead or toward the zenith, etc.) where the mounting surface of the automobile acts as a ground plane for the antenna assembly 700.

The fastener member 797 and retaining components 798, 799 allow the antenna assembly 700 to be installed and fixedly mounted to a vehicle body wall. The fastener member 797 and retaining components 798, 799 may first be inserted into a mounting hole in the vehicle body wall from an external side of the vehicle such that the chassis 718 is disposed on the external side of the vehicle body wall and the fastener 797 is accessible from inside the vehicle. In this stage of the installation process, the antenna assembly 700 may thus be held in place relative to the vehicle body wall in a first installed position.

The first retaining component 798 includes legs, and the second retaining component 799 includes tapered faces. The first and second retaining components 798, 799 also include aligned openings through which passes the fastener member 797 to be threadedly connected to a threaded opening in the chassis 718.

The legs of the first retaining component 798 are configured to make contact with the corresponding tapered faces of the second retaining component 799. When the first retaining component 798 is compressively moved generally towards the mounting hole by driving the fastener member 797 in a direction generally towards the antenna base 718, the legs may deform and expand generally outwardly relative to the mounting hole against the interior compartment side of the vehicle body wall, thereby securing the antenna assembly 700 to the vehicle body wall in a second, operational installed position.

The antenna assembly 700 includes a sealing member 701 (e.g., an O-ring, a resiliently compressible elastomeric or foam gasket, a PORON microcellular urethane foam gasket, etc.) that will be positioned between the chassis 718 and the roof of a car (or other mounting surface). The sealing member 701 may substantial seal the chassis 718 against the roof and substantially seal the mounting hole in the roof. The antenna assembly 700 also includes a sealing member 703 (e.g., an O-ring, a resiliently compressible elastomeric or foam gasket, caulk, adhesives, other suitable packing or sealing members, etc.) that is positioned between the radome 794 and the chassis 718 for substantially sealing the radome 794 against the chassis 718. In this example, the sealing member 703 may be at least partially seated within a groove defined along or by the chassis 718.

The antenna assembly 700 includes gaskets 705. In operation, the gaskets 705 help ensure that the chassis 718 will be grounded to a vehicle roof and also allows the antenna assembly 700 to be used with different roof curvatures. The gaskets 705 may include electrically-conductive fingers (e.g., metallic or metal spring fingers, etc.). In an exemplary embodiment, the gaskets 705 comprise fingerstock gaskets from Laird Technologies, Inc.

The cover or radome 794 is configured to be secured to the chassis 718. In this illustrated embodiment, the radome 794 is secured to the chassis 718 by mechanical fasteners 707 (e.g., screws, etc.). Alternatively, the radome 794 may secure to the chassis 718 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc.

Figure 30:
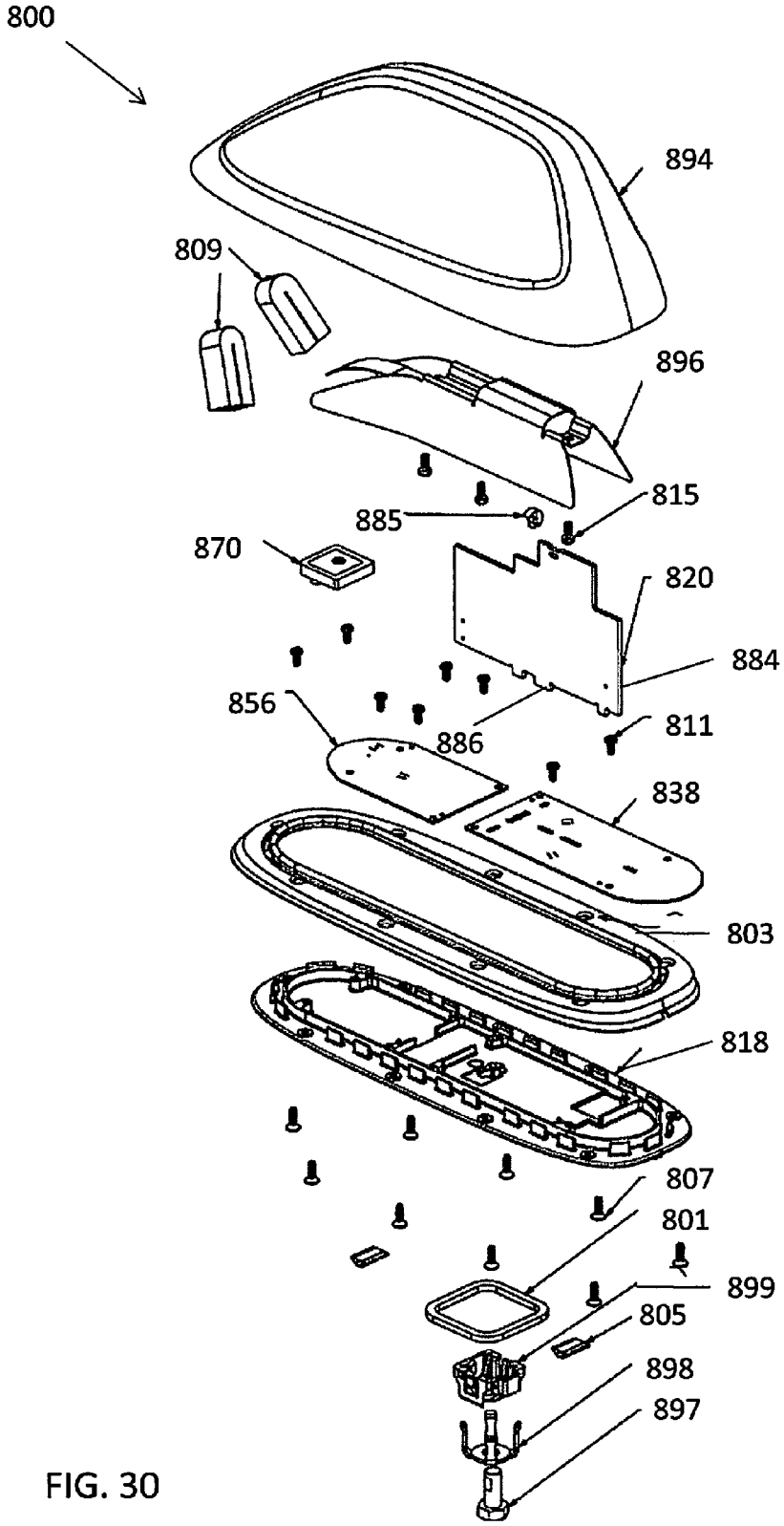
FIG. 30 is an exploded perspective view of an example embodiment of an antenna assembly including at least one or more aspects of the present disclosure.
Figure 31:
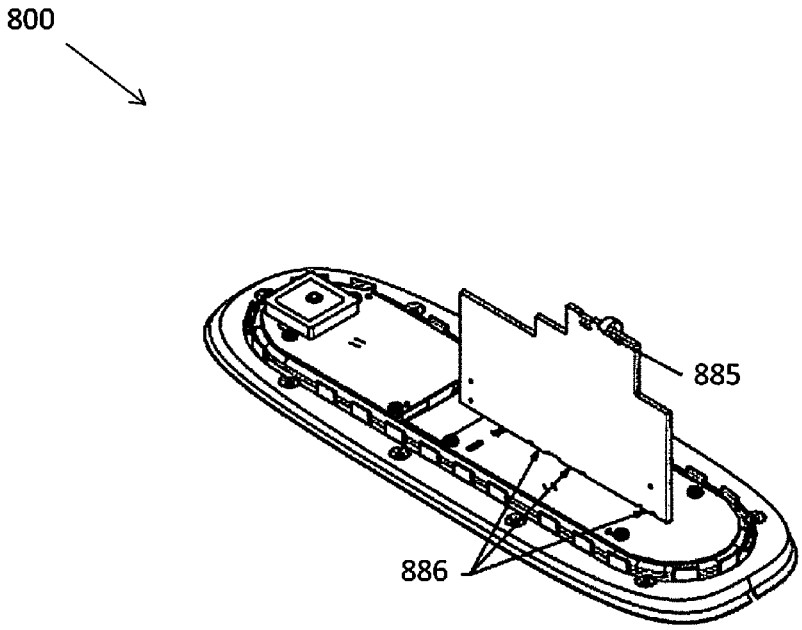
FIG. 31 is a perspective view of the antenna assembly shown in FIG. 30 after being assembled together.

FIG. 30 illustrates another example embodiment of an antenna assembly 800 including at least one or more aspects of the present disclosure. The antenna assembly 800 of this embodiment includes features similar to the antenna assembly 700 shown in FIG. 25. For example, the antenna assembly 800 includes a chassis 818 configured to couple the antenna assembly 800 to a mobile platform via a fastener member 897 (e.g., threaded mounting bolt having a hexagonal head, etc.), a first retention component 898 (e.g., an insulator clip, etc.), and a second retention component 899 (e.g., retaining clip, etc.). The antenna assembly 800 also includes sealing members 801 and 803, gaskets 805, and a radome 894. The radome 894 may be secured to the chassis 818 by mechanical fasteners 807 (e.g., screws, etc.).

The antenna assembly 800 includes first and second PCBs 838, 856 and two antennas 820 and 870. The antenna 870 is a patch antenna configured for use with global positioning systems (GPS) (e.g., configured for receiving desired GPS signals, etc.). This GPS antenna 870 is coupled to the chassis 818 at the second PCB 856 located toward a forward portion of the chassis 818. The second PCB 856 is fastened to the chassis 818 by mechanical fasteners 811. The GPS antenna 870 is electrically coupled to the second PCB 856 as desired (e.g., by a patch pin, etc.) and fastened thereto, e.g., by a mechanical fastener.

The antenna 820 is a vertical monopole antenna configured for use with AM/FM radio (e.g., configured for receiving desired AM/FM radio signals, etc.). The AM/FM antenna 820 includes, is defined by, etc. a PCB 884. The AM/FM antenna PCB 884 is coupled to the chassis 818 at the first PCB 838 located toward a rearward portion of the chassis 818. The first PCB 838 is coupled to the chassis 818 by mechanical fasteners 811, and the AM/FM antenna PCB 884 is coupled to the first PCB 838 by solder. Other suitable couplings may be used as desired. In addition, downwardly protruding tab portions 886 along the bottom of the AM/FM antenna PCB 884 interconnect with corresponding slot portions on the PCB 838 to further help position and/or couple the AM/FM antenna PCB 884 to the PCB 838.

Electrically conductive plating may be provided toward an upper portion of the AM/FM antenna 820 (e.g., toward an upper portion of the AM/FM antenna PCB 884, etc.) for capacitively loading the AM/FM antenna 820. This defines a capacitively loaded portion of the AM/FM antenna 820, toward an upper portion of the AM/FM antenna 820.

In addition, electrically conductive traces (broadly, electrical conductors) may be provided along a middle portion of the AM/FM antenna 820 (e.g., toward a middle portion of the AM/FM antenna PCB 884, etc.) for inductively loading the middle portion of the AM/FM antenna 820. This defines an inductively loaded portion of the AM/FM antenna 820, toward a middle portion of the AM/FM antenna 820. The traces may be etched around the PCB 884. The traces may be oriented generally parallel to each other along respective side surfaces of the AM/FM antenna PCB 884 and extend lengthwise along the AM/FM antenna PCB 884. End portions of the traces may curve around or extend through the AM/FM antenna PCB 884 (at locations toward side edge portions of the PCB 884) and thereby interconnect corresponding traces on the opposing side surfaces of the AM/FM antenna PCB 884. As such, the traces define a continuous electrical path generally coiling around at least part of the AM/FM antenna 820 (e.g., around the AM/FM antenna PCB 884 in a clockwise direction when viewed from above, etc.). By way of example, the antenna assembly 800 may include nine, ten, or eleven traces located along the AM/FM antenna PCB 884. Other antenna assemblies may include other numbers of traces (e.g., nine traces, eleven traces, etc.) as desired. In addition, the number of traces on each side of the AM/FM antenna PCB may be different.

A clip 885 (e.g., electrically-conductive spring clip, etc.) is coupled to (e.g., soldered, etc.) an upper portion of the AM/FM antenna PCB 884. The clip 885 is constructed from a suitable electrically conductive material (e.g., metal, etc.) and is configured to electrically connect to an insert 896 (e.g., a top load plate inserted into the cover, etc.) that is positioned and mechanically fastened (e.g., with mechanical fasteners 815, etc.) within the radome 894. As such, the clip 885 and insert 896 can operate to establish electrical contact between the AM/FM antenna 820 and the insert 896, whereby the insert 896 operates to form a capacitive load portion of the AM/FM antenna 820.

The antenna assembly 800 further includes foam pads 809. The foam pads 809 may be positioned about front portions of the insert 896, for example, to help hold the front portions in place and/or inhibit vibrations during travel of the vehicle to which the antenna assembly 800 in mounted.

Figure 32:
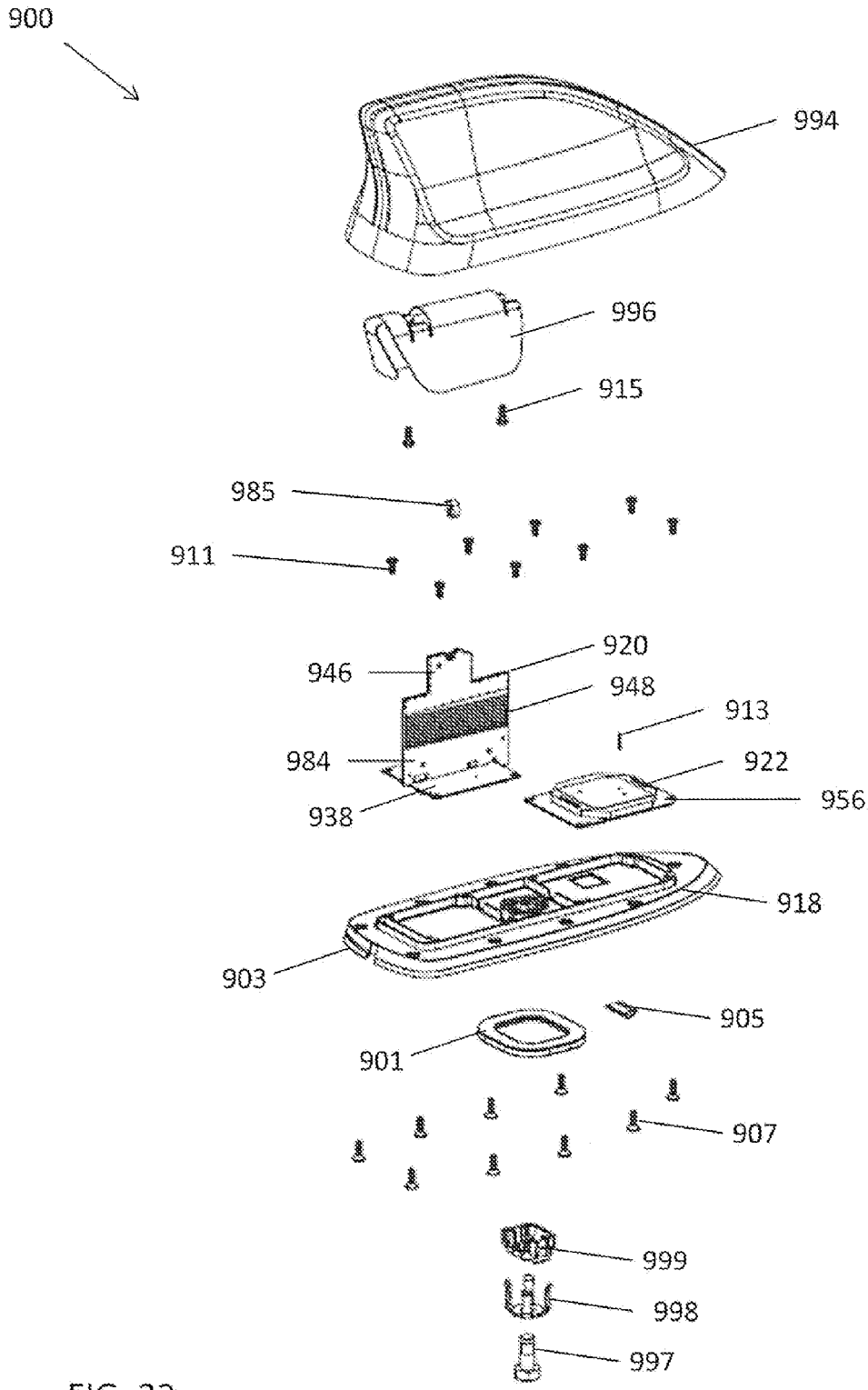
FIG. 32 is an exploded perspective view of an example embodiment of an antenna assembly including at least one or more aspects of the present disclosure.
Figure 33A:
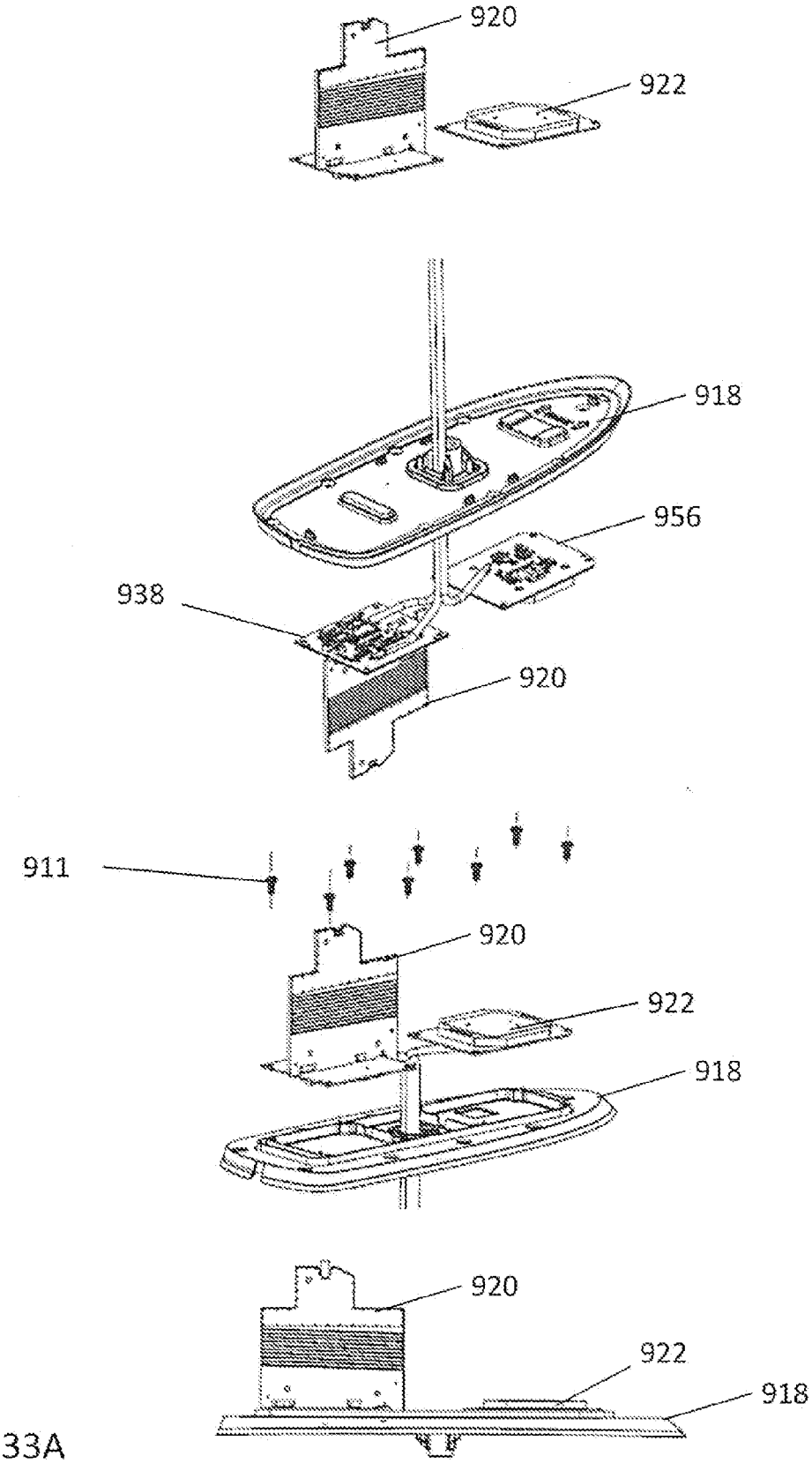
FIGS. 33A and 33B are perspective views illustrating an exemplary process for assembling the antenna assembly shown in FIG. 32.
Figure 33B:
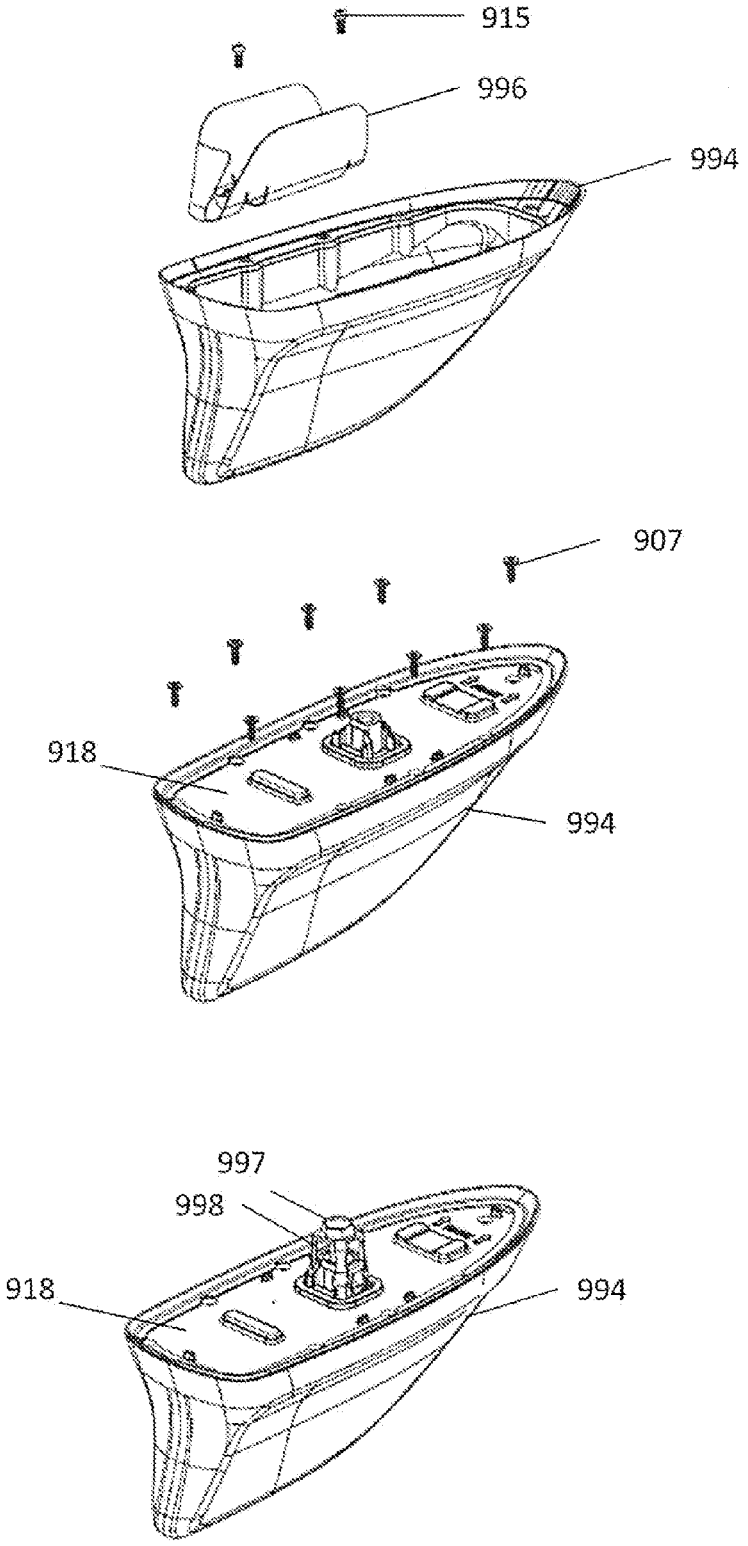

FIG. 32 illustrates another example embodiment of an antenna assembly 900 including at least one or more aspects of the present disclosure. The antenna assembly 900 of this embodiment includes features similar to the antenna assembly 700 shown in FIG. 25. For example, the antenna assembly 900 includes a chassis 918 configured to couple the antenna assembly 900 to a mobile platform via a fastener member 997 (e.g., threaded mounting bolt having a hexagonal head, etc.), a first retention component 998 (e.g., an insulator clip, etc.), and a second retention component 999 (e.g., retaining clip, etc.). The antenna assembly 900 also includes a sealing member 901, an overmolded dust seal 903 on the chassis 918, a gasket 905, and a radome 994. The radome 994 may be secured to the chassis 918 by mechanical fasteners 907 (e.g., screws, etc.).

The antenna assembly 900 includes first and second PCBs 938, 956 and two antennas 920 and 922. The antenna 922 is a patch antenna configured for use with satellite digital audio radio services (SDARS) (e.g., Sirius XM Satellite Radio, etc.) (e.g., configured for receiving/transmitting desired SDARS signals, etc.). This SDARS antenna 922 is coupled to the chassis 918 at the second PCB 956 located toward a forward portion of the chassis 918. The second PCB 956 is fastened to the chassis 918 by mechanical fasteners 911. The SDARS antenna 922 is electrically coupled to the second PCB 956 as desired (e.g., by a patch pin 913, etc.) and fastened thereto, e.g., by a mechanical fastener.

The antenna 920 is a vertical monopole antenna configured for use with AM/FM radio (e.g., configured for receiving desired AM/FM radio signals, etc.). The AM/FM antenna 920 includes, is defined by, etc. a PCB 984. The AM/FM antenna PCB 984 is coupled to the chassis 918 at the first PCB 938 located toward a rearward portion of the chassis 918. The first PCB 938 is coupled to the chassis 918 by mechanical fasteners 911, and the AM/FM antenna PCB 984 is coupled to the first PCB 938 by solder. Other suitable couplings may be used as desired. In addition, tab portions 986 of the AM/FM antenna PCB 984 interconnect with corresponding slot portions on the PCB 938 to further help position and/or couple the AM/FM antenna PCB 984 to the PCB 938.

Electrically conductive plating 946 may be provided toward an upper portion of the AM/FM antenna 920 (e.g., toward an upper portion of the AM/FM antenna PCB 984, etc.) for capacitively loading the AM/FM antenna 920. This defines a capacitively loaded portion of the AM/FM antenna 920, toward an upper portion of the AM/FM antenna 920.

In addition, electrically conductive traces 948 (broadly, electrical conductors) may be provided along a middle portion of the AM/FM antenna 920 (e.g., toward a middle portion of the AM/FM antenna PCB 984, etc.) for inductively loading the middle portion of the AM/FM antenna 920. This defines an inductively loaded portion of the AM/FM antenna 920, toward a middle portion of the AM/FM antenna 920. The traces 948 may be etched around the PCB 984. The traces 948 may be oriented generally parallel to each other along respective side surfaces of the AM/FM antenna PCB 984 and extend lengthwise along the AM/FM antenna PCB 984. End portions of the traces 948 may curve around or extend through the AM/FM antenna PCB 984 (at locations toward side edge portions of the PCB 984) and thereby interconnect corresponding traces 948 on the opposing side surfaces of the AM/FM antenna PCB 984. As such, the traces 948 define a continuous electrical path generally coiling around at least part of the AM/FM antenna 920 (e.g., around the AM/FM antenna PCB 984 in a clockwise direction when viewed from above, etc.). By way of example, the antenna assembly 900 may include ten traces 948 located along the AM/FM antenna PCB 984. Other antenna assemblies may include other numbers of traces (e.g., nine traces, eleven traces, etc.) as desired. In addition, the number of traces on each side of the AM/FM antenna PCB may be different.

A clip 985 (e.g., electrically-conductive spring clip, etc.) is coupled to (e.g., soldered, etc.) an upper portion of the AM/FM antenna PCB 984. The clip is constructed from a suitable electrically conductive material (e.g., metal, etc.) and is configured to electrically connect to an insert 996 (e.g., a top load plate inserted into the cover, etc.) that is positioned and mechanically fastened (e.g., with mechanical fasteners 915, etc.) within the radome 994. As such, the clip 985 and insert 996 can operate to establish electrical contact between the AM/FM antenna 920 and the insert 996, whereby the insert 996 operates to form a capacitive load portion of the AM/FM antenna 920.

Figure 34:
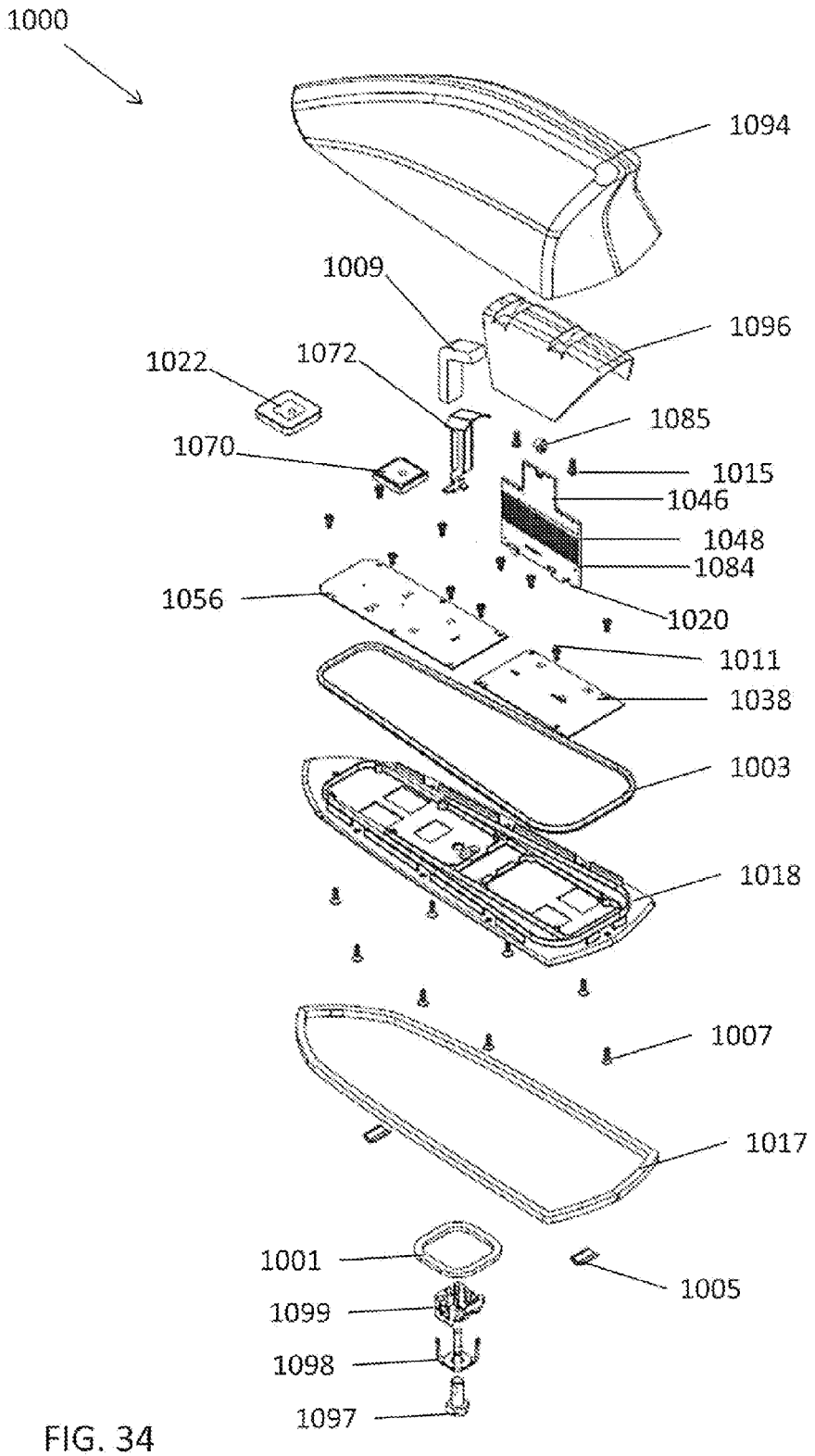
FIG. 34 is an exploded perspective view of an example embodiment of an antenna assembly including at least one or more aspects of the present disclosure.

FIG. 34 illustrates another example embodiment of an antenna assembly 1000 including at least one or more aspects of the present disclosure. The antenna assembly 1000 of this embodiment includes features similar to the antenna assembly 700 shown in FIG. 25. For example, the antenna assembly 1000 includes a chassis 1018 configured to couple the antenna assembly 1000 to a mobile platform via a fastener member 1097 (e.g., threaded mounting bolt having a hexagonal head, etc.), a first retention component 1098 (e.g., an insulator clip, etc.), and a second retention component 1099 (e.g., retaining clip, etc.). The antenna assembly 1000 also includes sealing members 1001, 1003, and 1017, gaskets 1005, and a radome 1094. The radome 1094 may be secured to the chassis 1018 by mechanical fasteners 1007 (e.g., screws, etc.).

The antenna assembly 1000 includes first and second PCBs 1038, 1056 and four antennas 1020, 1022, 1070, and 1072. The antenna 1022 is a patch antenna configured for use with satellite digital audio radio services (SDARS) (e.g., Sirius XM Satellite Radio, etc.) (e.g., configured for receiving/transmitting desired SDARS signals, etc.). This SDARS antenna 1022 is coupled to the chassis 1018 at the second PCB 1056 located toward a forward portion of the chassis 1018. The second PCB 1056 is fastened to the chassis 1018 by mechanical fasteners 1011. The SDARS antenna 1022 is electrically coupled to the second PCB 1056 as desired (e.g., by a patch pin, etc.) and fastened thereto, e.g., by a mechanical fastener.

The antenna 1070 is a patch antenna configured for use with global positioning systems (GPS) (e.g., configured for receiving desired GPS signals, etc.). This GPS antenna 1070 is coupled to the chassis 1018 via the second PCB 1056 at a location adjacent the SDARS antenna 1022. Alternatively, the GPS antenna 1070 could be stacked with the SDARS antenna 1022 (one on top of the other) on the second PCB 1056. The GPS antenna 1070 is electrically coupled to the second PCB 1056 as desired (e.g., by a patch pin, etc.) and fastened thereto, e.g., by a mechanical fastener.

The antenna 1072 is a vertical antenna configured for use with cell phones (e.g., for receiving desired cell phone signals, etc.). This cell phone antenna 1072 is coupled to the chassis 1018 at the second PCB 1056 at about a middle of the antenna assembly 1000.

The antenna 1020 is a vertical monopole antenna configured for use with AM/FM radio (e.g., configured for receiving desired AM/FM radio signals, etc.). The AM/FM antenna 1020 includes, is defined by, etc. a PCB 1084. The AM/FM antenna PCB 1084 is coupled to the chassis 1018 at the first PCB 1038 located toward a rearward portion of the chassis 1018. The first PCB 1038 is coupled to the chassis 1018 by mechanical fasteners 1011, and the AM/FM antenna PCB 1084 is coupled to the first PCB 1038 by solder. Other suitable couplings may be used as desired. In addition, tab portions along the bottom of the AM/FM antenna PCB 1084 interconnect with corresponding slot portions on the PCB 1038 to further help position and/or couple the AM/FM antenna PCB 1084 to the PCB 1038.

Electrically conductive plating 1046 may be provided toward an upper portion of the AM/FM antenna 1020 (e.g., toward an upper portion of the AM/FM antenna PCB 1084, etc.) for capacitively loading the AM/FM antenna 1020. This defines a capacitively loaded portion of the AM/FM antenna 1020, toward an upper portion of the AM/FM antenna 1020.

In addition, electrically conductive traces 1048 (broadly, electrical conductors) may be provided along a middle portion of the AM/FM antenna 1020 (e.g., toward a middle portion of the AM/FM antenna PCB 1084, etc.) for inductively loading the middle portion of the AM/FM antenna 1020. This defines an inductively loaded portion of the AM/FM antenna 1020, toward a middle portion of the AM/FM antenna 1020. The traces 1048 may be etched around the PCB 1084. The traces 1048 may be oriented generally parallel to each other along respective side surfaces of the AM/FM antenna PCB 1084 and extend lengthwise along the AM/FM antenna PCB 1084. End portions of the traces 1048 may curve around or extend through the AM/FM antenna PCB 1084 (at locations toward side edge portions of the PCB 1084) and thereby interconnect corresponding traces 1048 on the opposing side surfaces of the AM/FM antenna PCB 1084. As such, the traces 1048 define a continuous electrical path generally coiling around at least part of the AM/FM antenna 1020 (e.g., around the AM/FM antenna PCB 1084 in a clockwise direction when viewed from above, etc.). By way of example, the antenna assembly 1000 may include eleven traces 1048 located along the AM/FM antenna PCB 1084. Other antenna assemblies may include other numbers of traces (e.g., nine traces, ten traces, etc.) as desired. In addition, the number of traces on each side of the AM/FM antenna PCB 1084 may be different.

A clip 1085 (e.g., electrically-conductive spring clip, etc.) is coupled to (e.g., soldered, etc.) an upper portion of the AM/FM antenna PCB 1084. The clip is constructed from a suitable electrically conductive material (e.g., metal, etc.) and is configured to electrically connect to an insert 1096 (e.g., a top load plate inserted into the cover, etc.) that is positioned and mechanically fastened (e.g., with mechanical fasteners 1015, etc.) within the radome 1094. As such, the clip 1085 and insert 1096 can operate to establish electrical contact between the AM/FM antenna 1020 and the insert 1096, whereby the insert 1096 operates to form a capacitive load portion of the AM/FM antenna 1020.

The antenna assembly 1000 further includes foam 1009 (e.g., a foam pad, foam tape, etc.). The foam 1009 may be positioned relative to the insert 1096, for example, to help hold the insert 1096 in place and/or inhibit vibrations during travel of the vehicle to which the antenna assembly 1000 is mounted.

Figure 35:
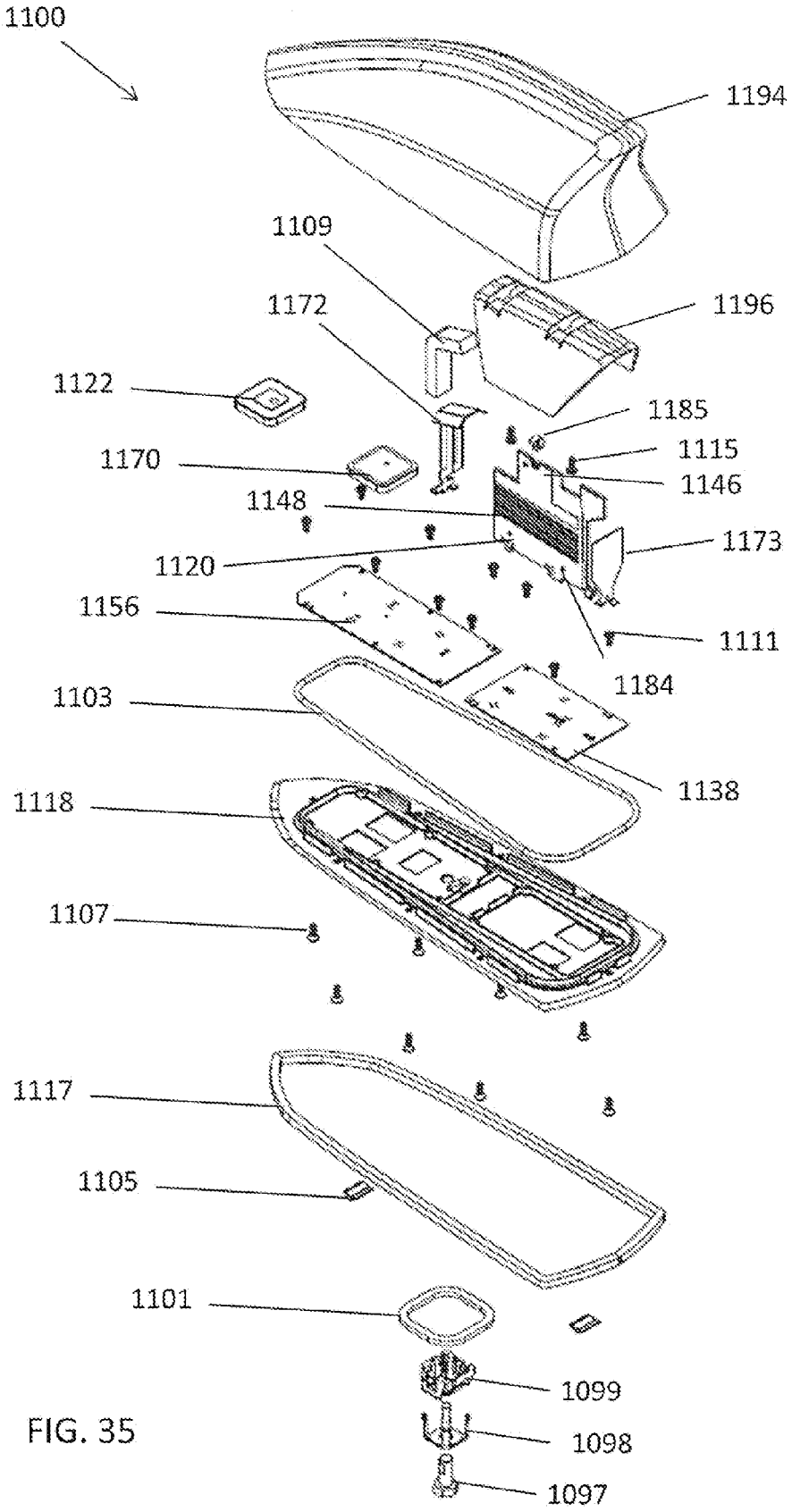
FIG. 35 is an exploded perspective view of an example embodiment of an antenna assembly including at least one or more aspects of the present disclosure.

FIG. 35 illustrates another example embodiment of an antenna assembly 1100 including at least one or more aspects of the present disclosure. In this exemplary embodiment, the antenna assembly 1100 is configured for use as a Multiple Input Multiple Output (MIMO) antenna assembly operable over multiple frequency bands, including LTE (Long Term Evolution) frequencies (e.g., 4G, 3G, other LTE generation, B17 (LTE), LTE (700 MHz), etc.).

The antenna assembly 1100 includes features similar to the antenna assembly 700 shown in FIG. 25. For example, the antenna assembly 1100 includes a chassis 1118 configured to couple the antenna assembly 1100 to a mobile platform via a fastener member 1197 (e.g., threaded mounting bolt having a hexagonal head, etc.), a first retention component 1198 (e.g., an insulator clip, etc.), and a second retention component 1199 (e.g., retaining clip, etc.). The antenna assembly 1100 also includes sealing members 1101, 1103, and 1117, gaskets 1105, and a radome 1194. The radome 1194 may be secured to the chassis 1118 by mechanical fasteners 1107 (e.g., screws, etc.).

The antenna assembly 1100 includes first and second PCBs 1138, 1156 and five antennas 1120, 1122, 1170, 1172, and 1173. The antenna 1122 is a patch antenna configured for use with satellite digital audio radio services (SDARS) (e.g., Sirius XM Satellite Radio, etc.) (e.g., configured for receiving/transmitting desired SDARS signals, etc.). This SDARS antenna 1122 is coupled to the chassis 1118 at the second PCB 1156 located toward a forward portion of the chassis 1118. The second PCB 1156 is fastened to the chassis 1118 by mechanical fasteners 1111. The SDARS antenna 1122 is electrically coupled to the second PCB 1156 as desired (e.g., by a patch pin, etc.) and fastened thereto, e.g., by a mechanical fastener.

The antenna 1170 is a patch antenna configured for use with global positioning systems (GPS) or global navigation satellite system (GLONASS). This GPS/GLONASS antenna 1170 is coupled to the chassis 1118 via the second PCB 1156 at a location adjacent the SDARS antenna 1122. Alternatively, the antenna 1170 could be stacked with the SDARS antenna 1122 (one on top of the other) on the second PCB 1156. The antenna 1170 is electrically coupled to the second PCB 1156 as desired (e.g., by a patch pin, etc.) and fastened thereto, e.g., by a mechanical fastener.

The antennas 1172 and 1173 are antenna elements configured for use with cell phones (e.g., for receiving desired cell phone signals, etc.). In operation, the antenna 1173 is operable as a first or primary cellular antenna that is operable for both receiving and transmitting communication signals within one or more cellular frequency bands. The antenna 1172 is operable as a second or secondary cellular antenna for receiving communication signals within one or more cellular frequency bands. The primary cell phone antenna 1173 is coupled to the chassis 1118 at the first PCB 1138 toward or adjacent a back of the assembly 1100. The secondary cell phone antenna 1172 is coupled to the chassis 1118 at the second PCB 1156 at about a middle of the antenna assembly 1100 such that the AM/FM antenna 1120 is between the cell phone antennas 1172 and 1173.

The antenna 1120 is a vertical monopole antenna configured for use with AM/FM radio (e.g., configured for receiving desired AM/FM radio signals, etc.). The AM/FM antenna 1120 includes, is defined by, etc. a PCB 1184. The AM/FM antenna PCB 1184 is coupled to the chassis 1118 at the first PCB 1138 located toward a rearward portion of the chassis 1118. The first PCB 1138 is coupled to the chassis 1118 by mechanical fasteners 1111, and the AM/FM antenna PCB 1184 is coupled to the first PCB 1138 by solder. Other suitable couplings may be used as desired. In addition, tab portions along the bottom of the AM/FM antenna PCB 1184 interconnect with corresponding slot portions on the PCB 1138 to further help position and/or couple the AM/FM antenna PCB 1184 to the PCB 1138.

Electrically conductive plating 1146 may be provided toward an upper portion of the AM/FM antenna 1120 (e.g., toward an upper portion of the AM/FM antenna PCB 1184, etc.) for capacitively loading the AM/FM antenna 1120. This defines a capacitively loaded portion of the AM/FM antenna 1120, toward an upper portion of the AM/FM antenna 1120.

In addition, electrically conductive traces 1148 (broadly, electrical conductors) may be provided along a middle portion of the AM/FM antenna 1120 (e.g., toward a middle portion of the AM/FM antenna PCB 1184, etc.) for inductively loading the middle portion of the AM/FM antenna 1120. This defines an inductively loaded portion of the AM/FM antenna 1120, toward a middle portion of the AM/FM antenna 1120. The traces 1148 may be etched around the PCB 1184. The traces 1148 may be oriented generally parallel to each other along respective side surfaces of the AM/FM antenna PCB 1184 and extend lengthwise along the AM/FM antenna PCB 1184. End portions of the traces 1148 may curve around or extend through the AM/FM antenna PCB 1184 (at locations toward side edge portions of the PCB 1184) and thereby interconnect corresponding traces 1148 on the opposing side surfaces of the AM/FM antenna PCB 1184. As such, the traces 1148 define a continuous electrical path generally coiling around at least part of the AM/FM antenna 1120 (e.g., around the AM/FM antenna PCB 1184 in a clockwise direction when viewed from above, etc.). By way of example, the antenna assembly 1100 may include eleven traces 1148 located along the AM/FM antenna PCB 1184. Other antenna assemblies may include other numbers of traces (e.g., nine traces, ten traces, etc.) as desired. In addition, the number of traces on each side of the AM/FM antenna PCB 1184 may be different.

A clip 1185 (e.g., electrically-conductive spring clip, etc.) is coupled to (e.g., soldered, etc.) an upper portion of the AM/FM antenna PCB 1184. The clip 1185 is constructed from a suitable electrically conductive material (e.g., metal, etc.) and is configured to electrically connect to an insert 1196 (e.g., a top load plate inserted into the cover, etc.) that is positioned and mechanically fastened (e.g., with mechanical fasteners 1115, etc.) within the radome 1194. As such, the clip 1185 and insert 1196 can operate to establish electrical contact between the AM/FM antenna 1120 and the insert 1196, whereby the insert 1196 operates to form a capacitive load portion of the AM/FM antenna 1120.

The antenna assembly 1100 further includes foam 1109 (e.g., a foam pad, foam tape, etc.). The foam 1109 may be positioned relative to the insert 1196, for example, to help hold the insert 1196 in place and/or inhibit vibrations during travel of the vehicle to which the antenna assembly 1100 in mounted.

Figure 36:
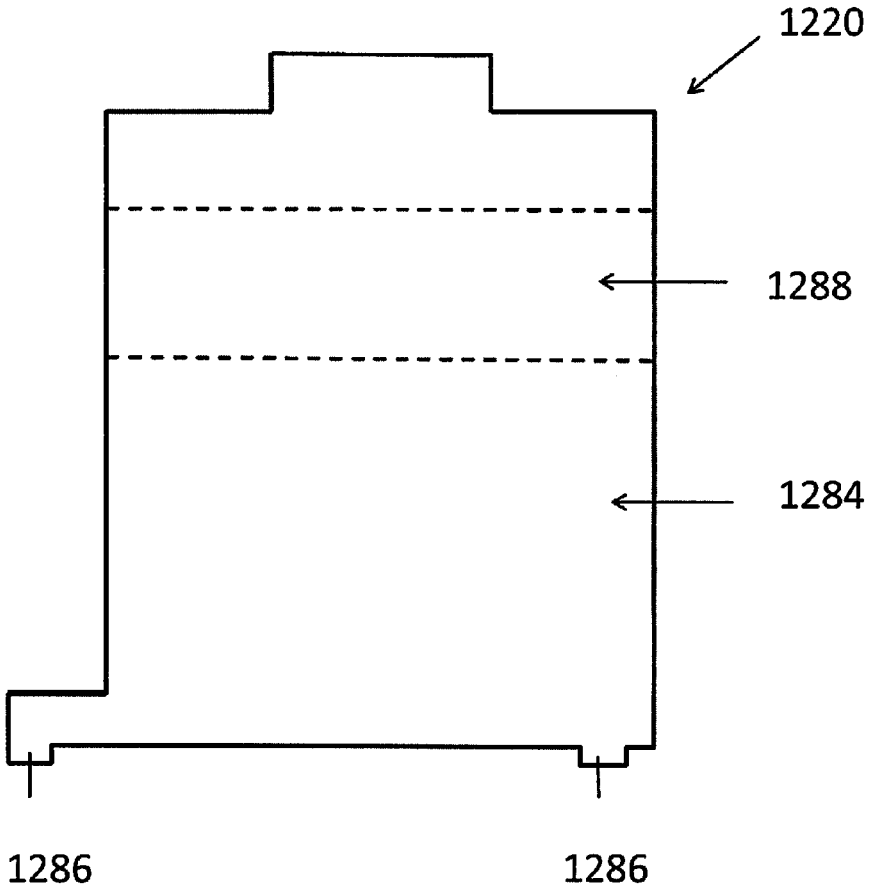
FIG. 36 is an elevation view of an example embodiment of an antenna suitable for use with example embodiments of antenna assemblies of the present disclosure.

FIG. 36 illustrates an example embodiment of an antenna 1220 suitable for use with example embodiments of antenna assemblies (e.g., antenna assembly 100, 200, 300, 400, 700, 800, 900, 1000, 1100, etc.) of the present disclosure. The illustrated antenna 1220 is a vertical monopole antenna configured for use with AM/FM radio (e.g., configured for receiving desired AM/FM radio signals, etc.). The AM/FM antenna 1220 can be coupled (physically, electrically, etc.) to a chassis (e.g., chassis 118, 218, 318, 418, 618, 718, 818, 918, 1018, 1118, etc.) of an antenna assembly (e.g., toward a rearward portion of the chassis, etc.) at a first PCB (e.g., first PCB 138, 238, 338, 438, 738, 838, 938, 1038, 1138, etc.) by suitable couplings (e.g., by mechanical fasteners, solder, any coupling disclosed herein, any other suitable coupling, etc.).

In the illustrated embodiment, the AM/FM antenna 1220 includes, is defined by, etc. a substrate 1284 (e.g., a PCB, etc.). Tab portions 1286 of the substrate 1284 can be used to help position and/or couple the substrate 1284 (and thus the AM/FM antenna 1220) on a chassis of an antenna assembly (e.g., on a first PCB of the antenna assembly, etc.).

Also in the illustrated embodiment, components (indicated generally at reference number 1288) such as, for example, electrical conductors (e.g., electrically conductive traces, wires, etc.), electrical components, electrically conductive plating, combinations thereof, other suitable components, etc. can be included with (e.g., provided on, coupled to, provided adjacent and coupled to, etc.) the substrate 1284. For example, electrical conductors can be provided (e.g., vertically, horizontally, diagonally, etc.) along (e.g., on, directly on, spaced apart from, etc.) a portion of the substrate 1284. In this example, the electrical conductors can define a continuous electrical path around at least part of the substrate 1284 (and the AM/FM antenna 1220) for inductively loading the portion of the substrate 1284 (and the AM/FM antenna 1220). The electrical conductors can be suitably oriented relative to the substrate 1284, for example, in a coil shape, spiral shape, helix shape, a box shape, etc. wrapping, extending, etc. around the substrate 1284 (e.g., in a clockwise direction, a counterclockwise direction, etc.) to help define the inductively loaded portion of the AM/FM antenna 1220. And also in this example, electrically conductive plating can be provided toward an upper portion of the substrate 1284 (suitably coupled to the electrical conductors, etc.) for capacitively loading the upper portion of the substrate 1284 (and the AM/FM antenna 1220). The electrically conductive plating can be suitably oriented along the substrate 1284 to help define the capacitively loaded portion of the AM/FM antenna 1220.

The broken lines shown in FIG. 35 are provided to generally indicate the components 1288 included with the substrate 1284. Similar broken lines may be included on an opposite side of the substrate 784. As such, the components 788 may be located along one side of the substrate 784 or along both sides of the substrate 784, as desired. In addition, the components 788 may be located at any suitable positions along the substrate 784 and not necessarily only within the area defined by the broken lines in FIG. 35 (e.g., all components 788 may be located within the area defined by the broken lines, some components 788 may be located within the area defined by the broken lines, none of the components 788 may be located within the area defined by the broken lines, etc.).

As described in connection with previous embodiments, a coupling wire can be used to electrically connect the AM/FM antenna 720 to a first PCB of an antenna assembly. For example, the coupling wire can connect through the first PCB (e.g., via a solder connection, etc.) to a lower portion of the components 788 included with the substrate 784. This can electrically connect the first PCB to the components 784, thereby helping define the inductively and capacitively loaded portions of the AM/FM antenna 720.

The AM/FM antenna 720 may be operable at one or more frequencies including, for example frequencies ranging between about 140 KHz and about 110 MHz, etc. For example, the illustrated AM/FM antenna 720 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM antenna 720 may also be tuned as desired for operation at desired frequency bands by, for example, adjusting dimensions of plating provided toward the upper portion of the AM/FM antenna 720, adjusting size and/or number and/or orientation and/or type of traces provided around the AM/FM antenna 720, etc. For example, the AM/FM antenna 720 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

The AM/FM antenna 720 may also include a structure (e.g., a clip, a tab, etc.) formed from suitable electrically conductive material (e.g., metal, etc.) and configured to engage an inner portion of a cover when the cover is positioned over the antenna 720. The cover could include a corresponding insert located within the inner portion of the cover and also constructed from a suitable electrically conductive material (e.g., metal, etc.). As such, when included, the structure of the AM/FM antenna 720 can operate to establish suitable electrical contact between the AM/FM antenna 720 and the cover, as desired, when the cover is located over the antenna 720.

The specific materials and dimensions provided herein are for purposes of illustration only as antenna assemblies (and their antennas) may be configured from different materials and/or with different dimensions depending, for example, on the particular end use and/or frequencies intended for the antenna assemblies Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally,"

"about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna configured for use with AM/FM radio, the antenna comprising multiple electrical conductors located toward a first side surface of the antenna and multiple electrical conductors located toward an opposing second side surface of the antenna, the multiple electrical conductors being interconnected around at least part of the antenna to thereby establish a continuous electrical path around the at least part of the antenna and define an inductively loaded portion of the antenna.

2. The antenna of claim 1, further comprising a capacitively loaded portion.

3. The antenna of claim 2, further comprising electrically conductive plating located toward an upper portion of the antenna, and wherein the upper portion of the antenna defines the capacitively loaded portion of the antenna.

4. The antenna of claim 1, wherein the electrical conductors include wires.

5. The antenna of claim 1, further comprising a printed circuit board, and wherein the electrical conductors are defined by traces located on first and/or second side surfaces of the printed circuit board.

6. The antenna of claim 1, wherein the antenna is configured for operation at one or more frequencies ranging between about 140 kilohertz and about 110 megahertz.

7. The antenna of claim 1, wherein a height of the antenna is about 55 millimeters or less.

8. The antenna of claim 7, wherein the antenna defines a footprint having a length of about 65 millimeters or less and a width of about 30 millimeters or less.

9. An antenna assembly comprising the antenna of claim 1 in combination with at least one additional antenna, the antenna and the at least one additional antenna being co-located on a common base.

10. A low-profile antenna assembly suitable for use with a mobile platform, the antenna assembly comprising:

a chassis; and at least two antennas co-located on the chassis;

wherein at least one of the at least two antennas includes a first antenna operable at one or more frequencies ranging between about 140 kilohertz and about 110 megahertz;

wherein the antenna assembly has a height of about 60 millimeters or less; and wherein the first antenna includes a printed circuit board and multiple electrical conductors located along opposing first and second side surfaces of the printed circuit board, the electrical conductors defining an inductively loaded portion of the first antenna; and wherein the printed circuit board further includes electrically conductive plating defining a capacitively loaded portion of the first antenna.

11. The antenna assembly of claim 10, wherein the antenna assembly has a height of about 55 millimeters or less.

12. The antenna assembly of claim 10, wherein at least one of the at least two or more antennas includes a second antenna configured for use with at least one or more of cell phones, satellite digital audio radio services, global positioning systems, Wi-Fi, Wi-Max, and digital audio broadcasting.

13. The antenna assembly of claim 10, wherein the at least two antennas include at least four antennas configured for use with at least one or more of cell phones, satellite digital audio radio services, global positioning systems, Wi-Fi, Wi-Max, and digital audio broadcasting.

14. The antenna assembly of claim 10, wherein the first antenna includes:

a first end flange;

a second end flange;

a web positioned at least partly between the first end flange and the second end flange; and electrical conductors extending between the first end flange and the second end flange;

wherein the web defines a capacitively loaded portion of the first antenna and the electrical conductors define an inductively loaded portion of the first antenna.

15. An antenna assembly suitable for use with a mobile platform, the antenna assembly comprising:

a chassis configured to be mounted on a mobile platform;

a first antenna coupled to the chassis and configured for use with AM/FM radio, the first antenna having electrical conductors establishing a continuous electrical path around at least part of the first antenna and thereby defining an inductively loaded portion of the first antenna, and wherein an upper portion of the first antenna defines a capacitively loaded portion of the first antenna; and a second antenna coupled to the chassis and configured for use with at least one or more of cell phones, satellite digital audio radio services, global positioning systems, Wi-Fi, Wi-Max, and digital audio broadcasting;

wherein the first antenna has a height of about 55 millimeters or less and defines a footprint having a length of about 65 millimeters or less and a width of about 30 millimeters or less.

16. The antenna assembly of claim 15, wherein the second antenna is configured for use with satellite digital audio radio services.

17. The antenna assembly of claim 15, wherein the second antenna is configured for use with global positioning systems, the antenna assembly further comprising a third antenna configured for use with cell phones and a fourth antenna configured for use with Wi-Fi.

18. The antenna assembly of claim 15, wherein the second antenna is configured for use with global positioning systems, the antenna assembly further comprising a third antenna configured for use with cell phones and a fourth antenna configured for use with digital audio broadcasting.

19. The antenna assembly of claim 15, wherein the first antenna includes a printed circuit board, the electrical conductors including traces located on opposing first and second side surfaces of the printed circuit board.

* * * * *